US006691490B1

(12) United States Patent
Yuyama et al.

(10) Patent No.: US 6,691,490 B1
(45) Date of Patent: Feb. 17, 2004

(54) INJECTION DRUG PACKAGING DEVICE

(75) Inventors: Shoji Yuyama, Osaka (JP); Hiroshi Nose, Osaka (JP); Tsuyoshi Kodama, Osaka (JP); Kunihiko Kano, Osaka (JP); Masahiko Kasuya, Osaka (JP); Yasuhiro Shigeyama, Osaka (JP)

(73) Assignee: Kabushiki Kaisha Yuyama Seisakusho, Toyonaka (JP)

( * ) Notice: Subject to any disclaimer, the term of this patent is extended or adjusted under 35 U.S.C. 154(b) by 0 days.

(21) Appl. No.: 09/486,470

(22) Filed: Feb. 28, 2000

Related U.S. Application Data

(63) Continuation of application No. PCT/JP99/03465, filed on Jun. 28, 1999.

(30) Foreign Application Priority Data

Jun. 30, 1998 (JP) ..... 10-184620
Jul. 17, 1998 (JP) ..... 10-203749

(51) Int. Cl.[7] ..... B65B 61/26

(52) U.S. Cl. ..... 53/131.4; 53/247; 53/252; 53/259; 53/570

(58) Field of Search ..... 53/131.4, 570, 53/571, 247, 252, 259, 258, 386.1, 534, 260

(56) References Cited

U.S. PATENT DOCUMENTS 3,579,948 A * 5/1971 Bernard ..... 53/386.1
3,932,982 A * 1/1976 Klapp ..... 53/259
4,242,854 A * 1/1981 Nissen ..... 53/252
4,261,159 A * 4/1981 Aiuola et al. ..... 53/259
4,476,664 A * 10/1984 Kroll et al. ..... 53/259
4,510,736 A * 4/1985 Miiller ..... 53/386.1
4,570,419 A * 2/1986 Tinsley ..... 53/247
4,807,754 A * 2/1989 Rowe ..... 493/194
4,989,391 A * 2/1991 Wetter ..... 53/131.4
5,022,216 A * 6/1991 Muckenfuhs et al. ..... 53/259
5,107,656 A * 4/1992 Katz et al. ..... 53/131.4
5,125,604 A * 6/1992 Vrooman et al. ..... 248/97
5,452,559 A * 9/1995 Lipes ..... 53/570
5,461,846 A * 10/1995 Cormier et al. ..... 53/570
5,502,949 A * 4/1996 Main et al. ..... 53/247
5,588,285 A * 12/1996 Odenthal ..... 53/260
5,776,510 A * 7/1998 Reichental et al. ..... 53/570
5,794,415 A * 8/1998 Huff et al. ..... 53/259
6,024,221 A * 2/2000 Yuyama et al. ..... 206/528
6,094,895 A * 8/2000 Ravizza ..... 53/570

FOREIGN PATENT DOCUMENTS

| | | |
|---|---|---|
| JP | 50-63726 | 11/1976 |
| JP | 57-135826 | 3/1984 |
| JP | 61-19436 | 8/1987 |
| JP | 6-24418 | 2/1994 |
| JP | 57-198027 | 5/1994 |
| JP | 7-112718 | 5/1995 |
| JP | 10-323380 | 12/1998 |

* cited by examiner

*Primary Examiner*—Eugene Kim
*Assistant Examiner*—Sameh Tawfik
(74) *Attorney, Agent, or Firm*—Wenderoth, Lind & Ponack, L.L.P.

(57) ABSTRACT

A drug packaging system including a bag supply unit (A) for printing injection drug information on bags and feeding the bags, a drug feed unit (B) for putting drugs specified the doctors' orders into each of the bags (206) received from the bag supply unit (A), and a packaging unit for putting the bags (206) into a bucket (209). The packaging unit includes a bed (230) for supporting bags, a mouth-opening means (231, 232) for opening the mouth of the bag on the bed, and a chute (233) through which drugs are fed into the bag on the bed through the bag mouth. The bed (230) is pivotable between a position for putting drugs into the bag and a position for dispensing the bag.

15 Claims, 27 Drawing Sheets

INJECTION DRUG PACKAGING DEVICE

BACKGROUND OF THE INVENTION

1. Field of the Invention

This invention relates to a drug packaging device for use in an injection drug dispenser system for dispensing injection drugs in the form of e.g. ampules or vials based on doctors' orders.

2. Description of Related Art

Many modern hospitals and pharmacies use drug preparation assisting systems to improve efficiency and accuracy of preparation of drugs. FIG. 36 shows one of such injection drug dispenser systems.

This system includes a conveyor 1, a bucket stocker 2 provided at the upstream side of the conveyor 1, and a bucket lifter 3 provided at the downstream side. Drug dispensers 4, 5 for dispensing ampules and vials for injection and a printer 6 for printing doctors' orders are provided along the conveyor 1 between the bucket stocker 2 and the bucket lifter 3. A control unit 18 controls the units 1–6 based on data from a dispensing instructing computer 19.

The computer 19 is connected to e.g. a hospital host computer. Each time a batch of data from the host computer are received by the computer 19, the control unit 18 deposits one bucket 7 onto the conveyor 1 from the bucket stocker 2. Necessary drugs are put into the bucket 7 from the dispensers 4, 5, and doctors' orders are put into the bucket 7 from the printer 6. The buckets 7 are discharged by the lifter 3 and loaded into a rack 16.

An operator then inspects each bucket 7 in the rack 16 to check against doctor's order if the drugs therein are in order and not damaged, and delivers the rack 16 to a designated station.

At the designated station, different hospital workers mix the contents of designated ampules and vials to prepare an injection or drip fluid for one-time use. The empty buckets are returned to the rack 16 and the rack is returned to the pharmacy.

Since one bucket is needed for each patient, a large number of buckets are needed in a large hospital. If amuples and vials corresponding to plural doctors' orders are contained in a bucket, a hospital worker has to take care not to mix wrong drugs together.

Collecting empty buckets is troublesome. A large rack 16 is needed to store a large number of buckets.

The present invention has as an object to avoid a packaging mistake while rationalizing the injection drug distributing work.

SUMMARY OF THE INVENTION

In order to solve the above-described problem, the present invention provides an injection drug packaging device comprising a mouth-opening means for opening the mouth of each of continuously supplied drug bags, and a feed unit for feeding injection drugs into each of the drug bags through its mouth.

According to such an arrangement, injection drugs are packaged in units for a single use. Thus, mistakes in the packaging of the drugs are avoided.

Also, since one bucket can contain drug bags for a plurality of patients, injection drugs can be distributed in a smaller number of buckets. Thus, bucket stocking racks are not necessary. Rack collecting work and space for the racks are no longer needed.

The mouth-opening means may comprise a first mouth-opening means for opening the mouth of the drug bag by sucking the bag from both sides, and a second mouth-opening means comprising an arm adapted to be inserted into the mouth of the bag to further widen the mouth. This arrangement ensures that the mouth of the bag is opened reliably so that drugs can be fed into the bag.

The device may comprise a means for putting the bags containing injection drugs into a bucket, and a means for moving the bucket in association with the action of putting the bags into the bucket. Thus the drug bags can be contained neatly in the bag.

The device may further comprise a cutter unit for forming a hole in each of the bags near its mouth. By use of the hole the drug bag can be suspended from the drug bottle.

The means for putting the bags into a bucket and the means for moving the bucket are structured to lay bags flat in the bucket so as to overlap with each other. This arrangement improves the bag containing efficiency of a bucket.

An injection drug packaging device according to this invention may comprise a bag supply unit for printing information regarding the injection drugs specified in doctors' orders on bags and feeding the bags, and a packaging unit for putting drugs specified in the doctors' orders into each of the bags received from the bag supply unit and putting the bags into a bucket. The packaging unit comprises a bed for supporting the bags, a mouth-opening means for opening the mouth of the bag on the bed, and a chute through which injection drugs are fed into the bag on the bed through its mouth. The bed is pivotable between a position for putting injection drugs into the bag on the bed and a position for dispensing the bag on the bed.

With this packaging device, there is no need of bags being transferred between two or more beds or no need of a conveyor being inserted into a drug bag. This results in a relatively simple configuration which is applicable to drug bags of a small size.

The mouth-opening means may comprise a first mouth-opening means for opening the mouth of a bag by sucking the bag from both sides, and a second mouth-opening means for increasing the volume of the bag by blowing air into the bag. This arrangement eliminates the need for an arm for secondary opening of the mouth of a bag.

The bag supply unit may comprise a cutter unit for forming a hole in each bag. A transfusion bottle is engageable. The cutter unit comprises a cutter for forming perforations along a line defining the hole, a cutter support provided opposite the cutter, and a presser for urging the cutter into a bag sandwiched between the presser and the cutter support.

With this arrangement, when the perforations for a hole are formed, the bag is empty and flat. Thus, the perforations can be formed reliably. Also, when drugs are put into each bag, no hole has been formed yet. Thus, there is no possibility of drugs coming out of the bag.

The cutter may comprise a plurality of blades having cutting edges that are inclined. Accordingly, the cutting edges are brought into point contact with the bag when cutting into the bag. With this arrangement, perforations can be formed more easily than with a cutter having straight cutting edges.

DETAILED DESCRIPTION OF THE INVENTION

The embodiments are described with reference to the accompanying drawings. For some units described in the prior art description, the same numerals are employed and description thereof is omitted.

Figure 1:
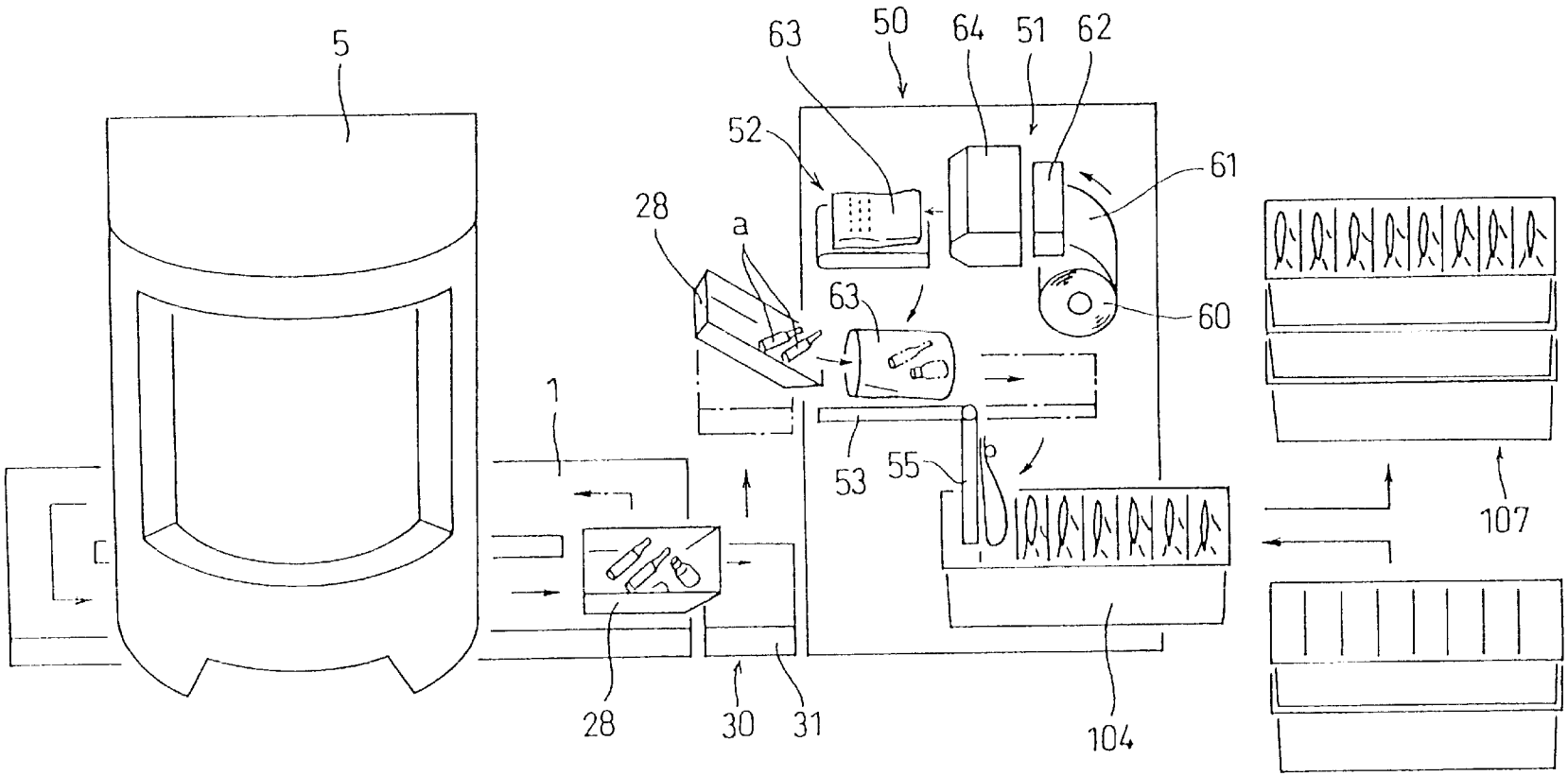
FIG. 1 is a schematic view of an injection drug dispenser system employing a packaging unit embodying the present invention.
Figure 36:
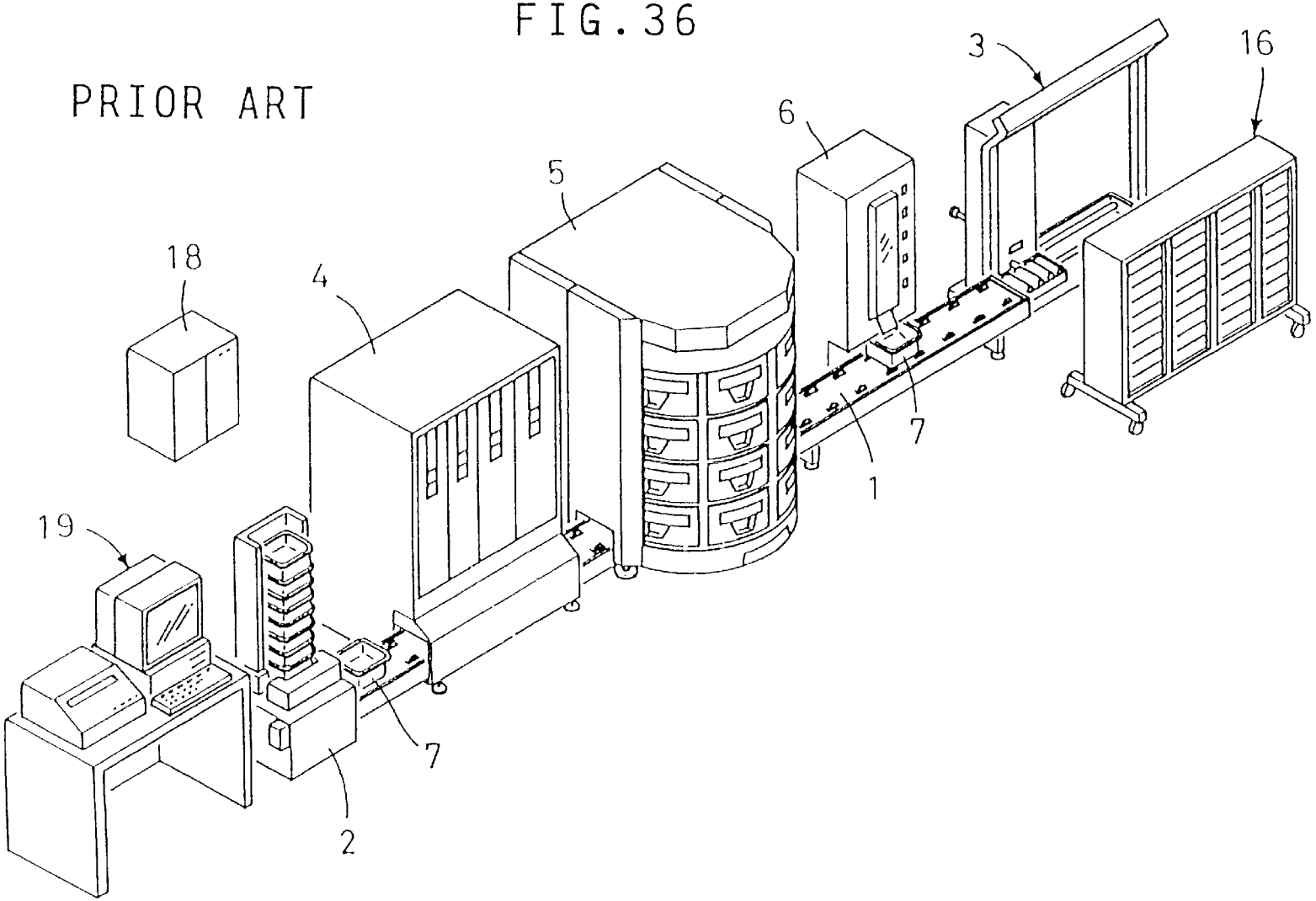
FIG. 36 PRIOR ART
FIG. 36 is a perspective view of a conventional injection drug dispensing system.

Referring first to FIG. 1, the dispenser system of the present invention does not include a bucket stocker 2, printer 6, bucket lifter 3 and rack 16, which re used in the conventional system shown in FIG. 36. The conveyor unit 1 forms an endless loop. An elevator 30 and a packaging unit 50 are provided at one side of the conveyor 1.

Figure 3:
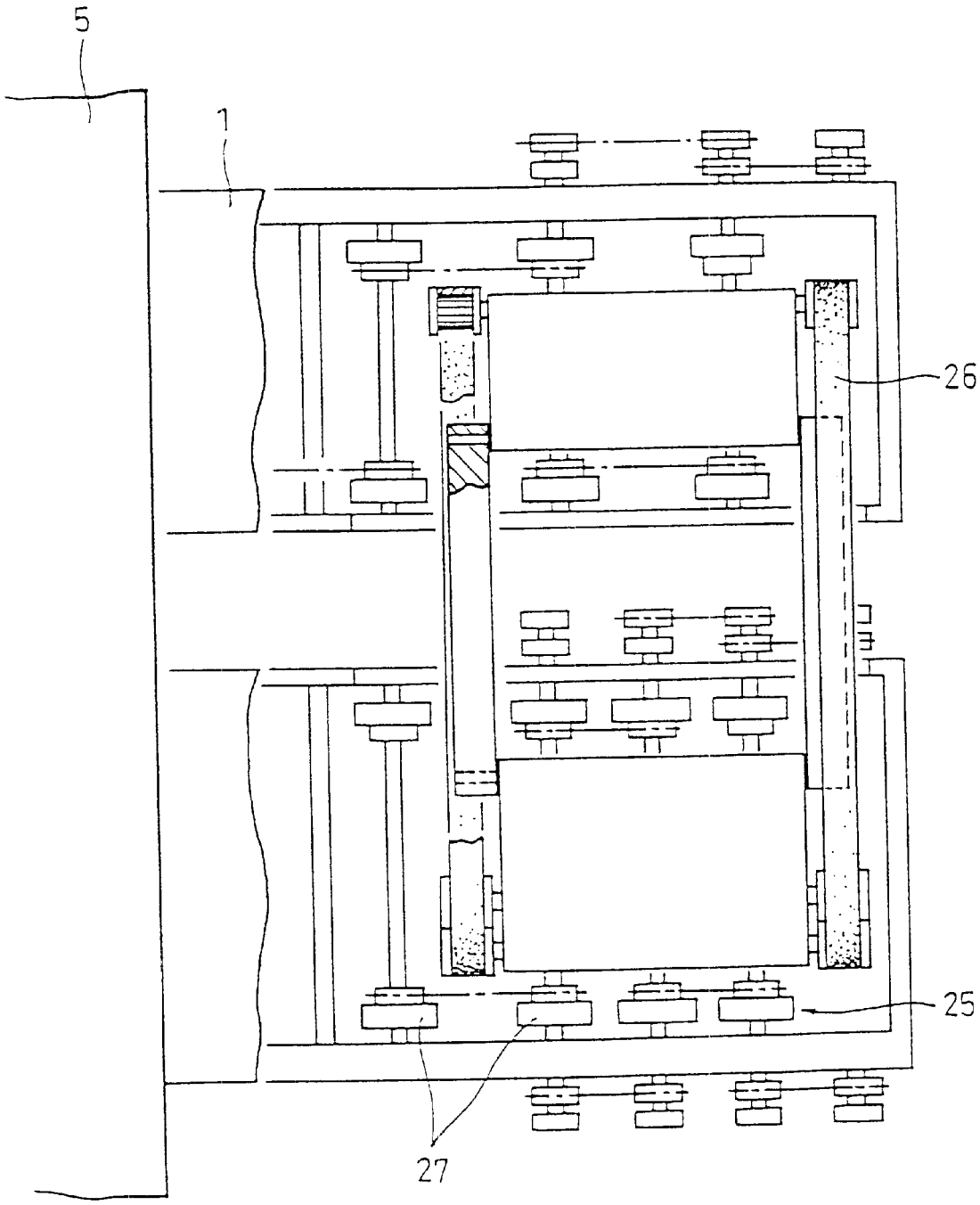
FIG. 3 is a plan view of a tray conveyor unit.

As shown in FIG. 3, the conveyor unit 1 comprises roller conveyors 25 combined with belt conveyors 26 which are elevated between rollers 27 of the roller conveyors 25.

A plurality of trays 28 containing the injection drugs (a), which are dispensed from the dispenser 5 in accordance with each doctor's order, are fed in a circle. Each of the trays 28 is stopped at a predetermined position and put on the stage 31 of the elevator 30 and returned therefrom. Each tray 28 is provided on its back with a projection 28a adapted to engage a shoulder on the stage 31 (FIG. 10) to prevent the tray 28 from slipping down when the stage 31 is in an inclined position.

When the elevator 30 is raised to the highest level, the control unit 18 inclines the stage 31 to dump the ampules or vials in the tray 28 on the stage 31 into a packaging unit 50, then levels the stage 31, and lowers the elevator 30 to return the now empty tray onto the conveyor 1.

Figure 2:
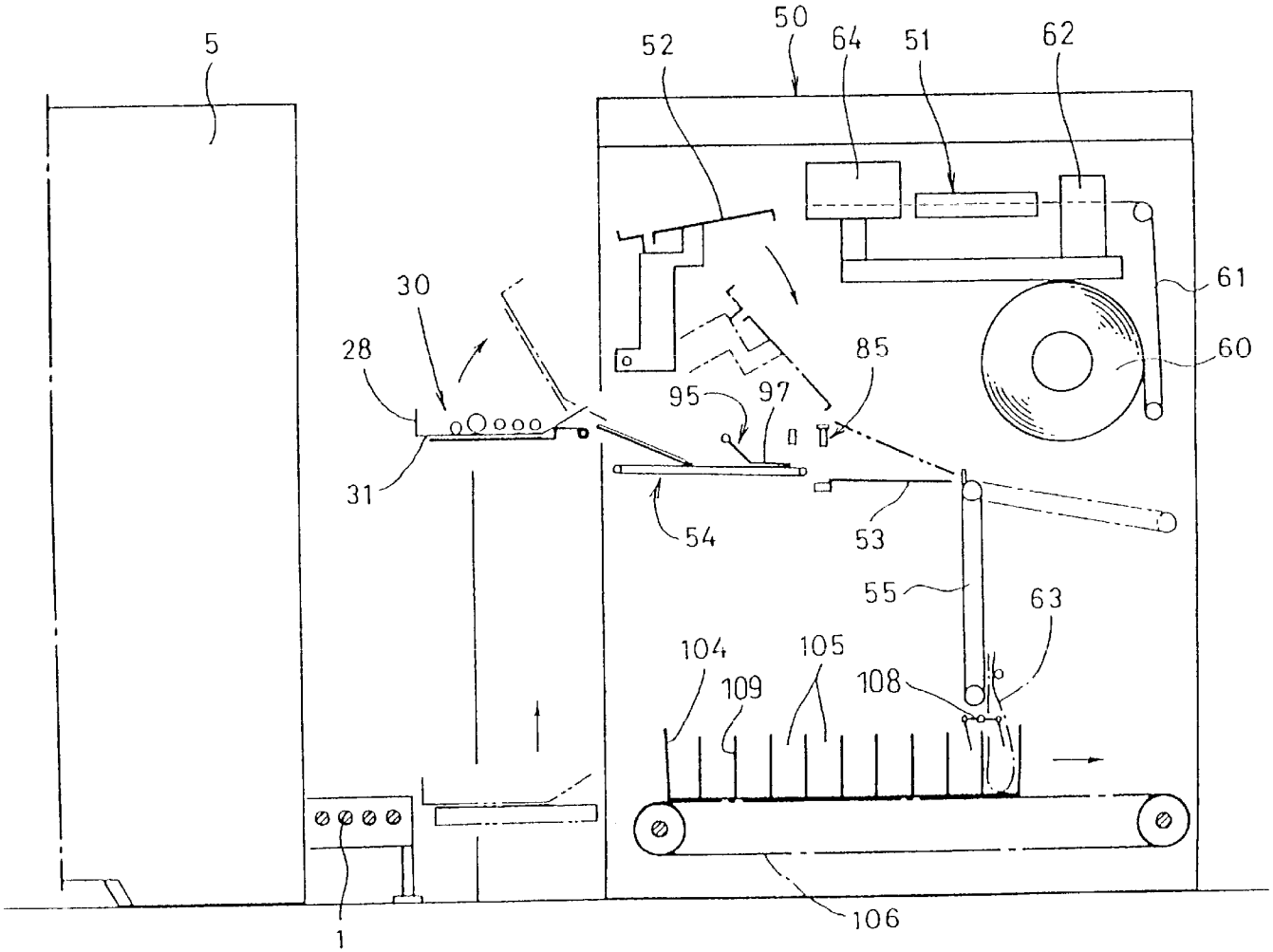
FIG. 2 is a partial front view of the packaging unit shown in FIG.1.
Figure 4:
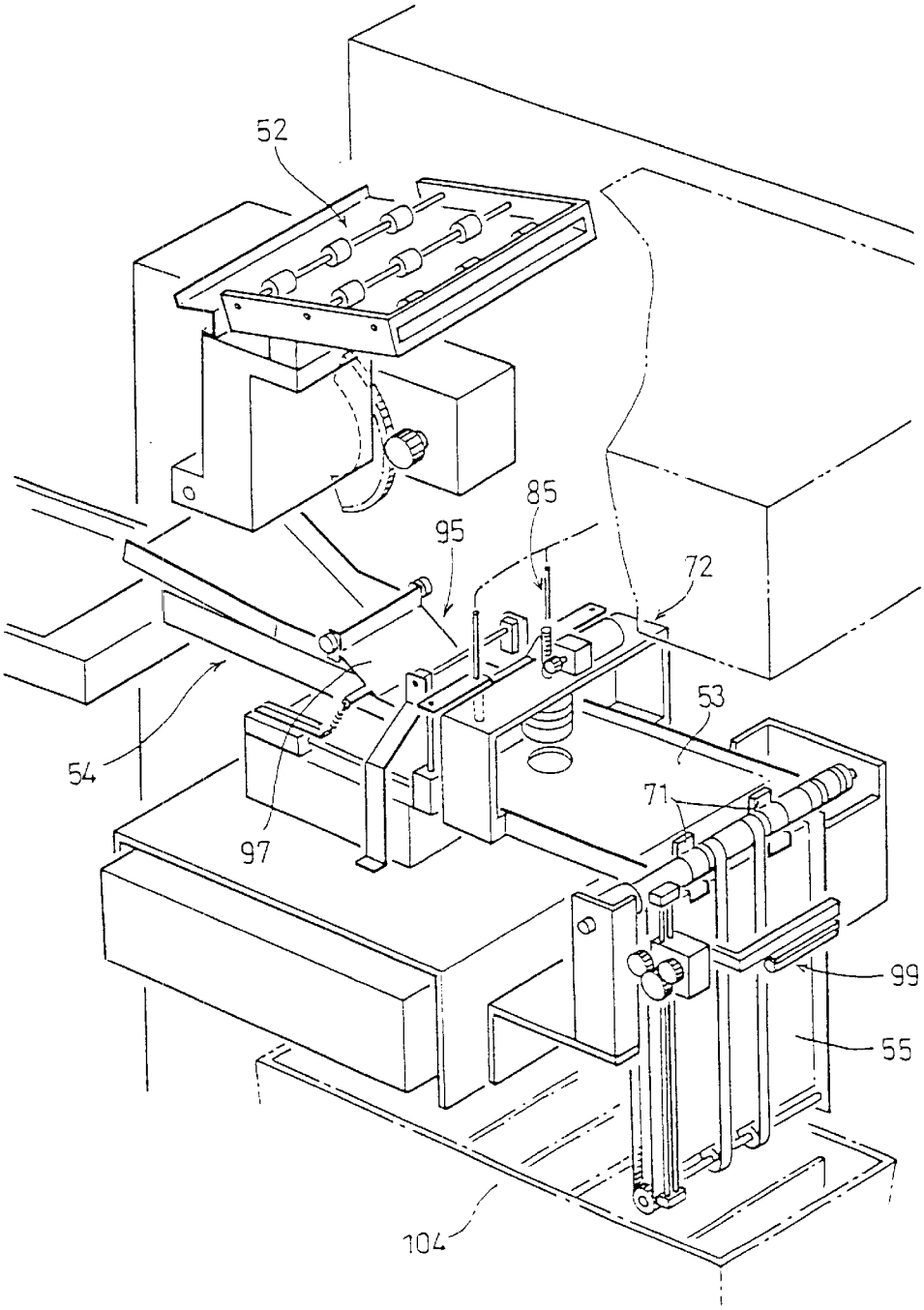
FIG. 4 is a perspective view of the packaging unit.

The packaging unit 50 of the invention, includes, as shown in FIGS. 1, 2 and 4, a bag making/printer unit 51, a bag feeder 52, a packaging bed 53, a drug feed unit 54, and a dumping bed 55. The bag making/printer unit 51 has a shaft on which is mounted a roll 60 of a heat-fusible double-layer sheet 61 comprising a substrate and a transparent laminate layer having both side edges thereof fused to the substrate, a heat sealer 62 for transversely heat-sealing the sheet 61 at predetermined intervals, and cutting the sheet along transverse lines upstream or downstream of the transverse seal lines to form bags 63 having one end open, and a printer 64 for printing necessary information on the outer side of the substrate of each bag. But instead of providing the bag making/printer unit 51, ready-made bags can be fed into the printer 64.

Figure 5:
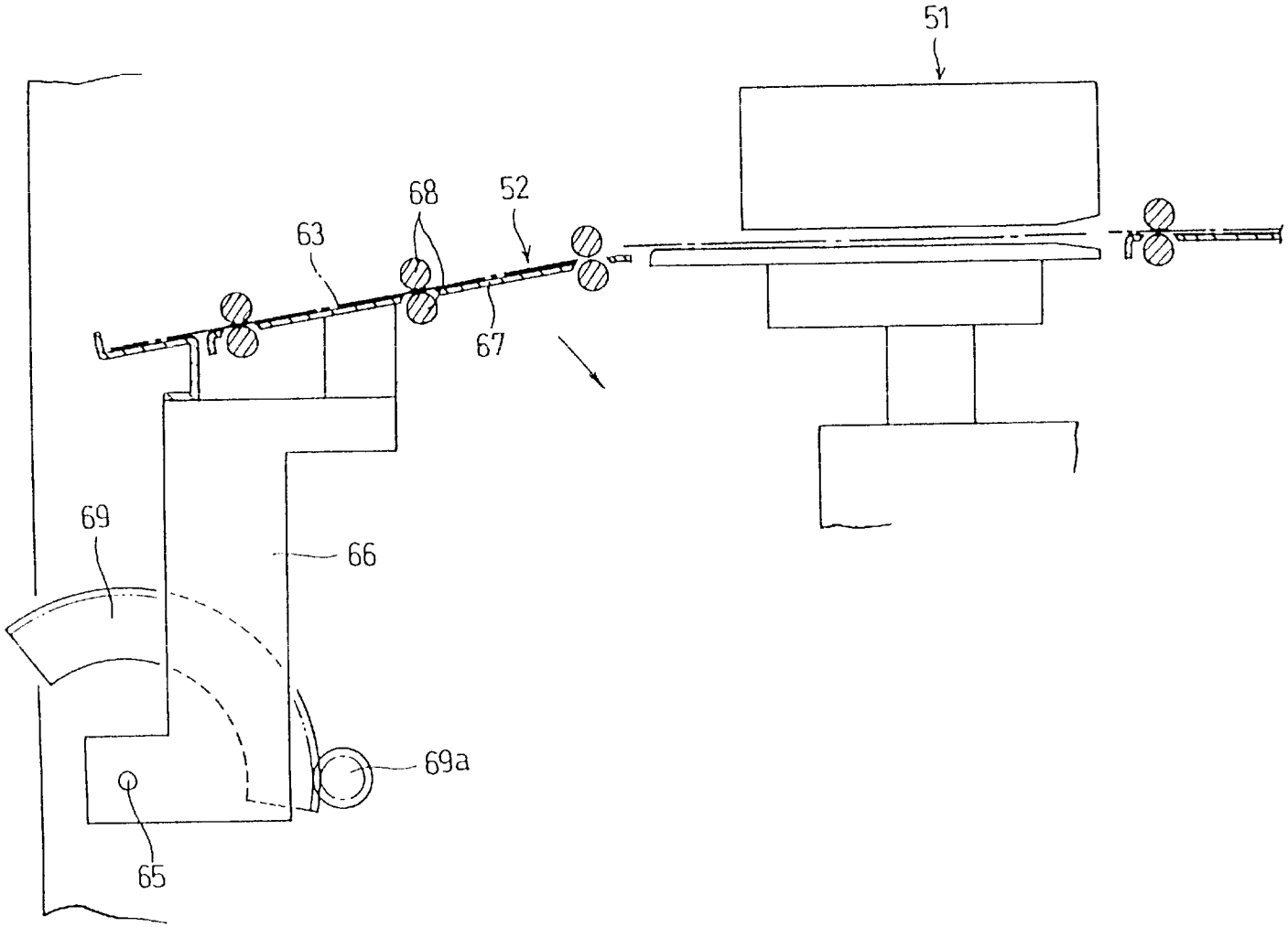
FIG. 5 are front views of a printer unit and a bag feeder.
Figure 6:
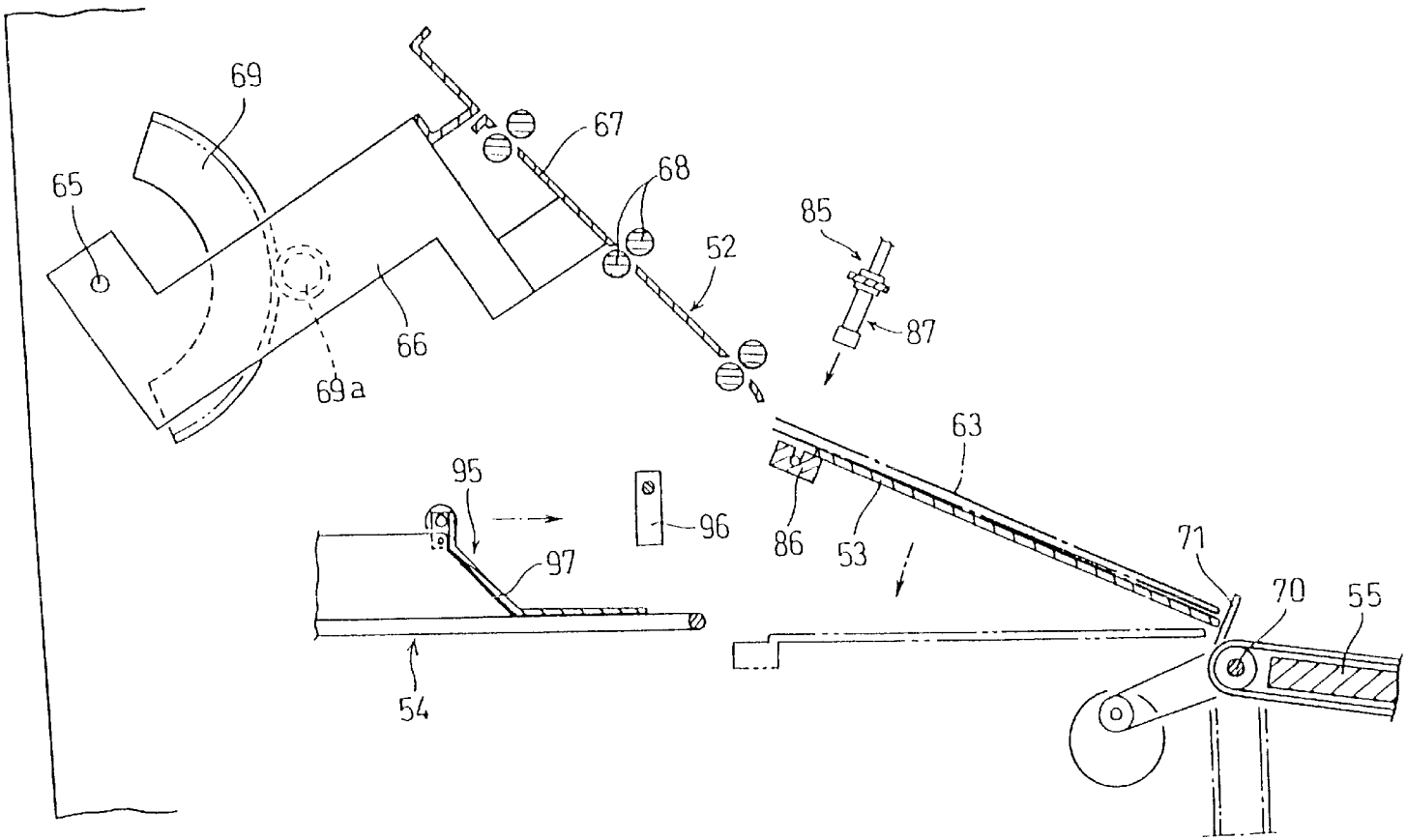
FIG. 6 is a front view of the bag feeder and a packaging bed.

The packaging unit 50 further includes a bag feeder 52. As shown in FIGS. 5 and 6, the bag feeder has an arm 66 that is pivotable about a shaft 65 and carries at its free end a frame 67 on which drug bags 63 are fed by pairs of vertically arranged rollers 68. A sensor is mounted on the frame 67 to detect bags on the frame. A sector rack 69 is secured to the arm 66 and is in mesh with a pinion 69*a*. Thus, by rotating the pinion 69*a*, the arm 66 pivots about the shaft 65 so that the frame 67 is movable between a substantially horizontal position (FIG. 5) and an inclined position (FIG. 6). In the horizontal position, a bag 63 is fed onto the frame 67 from the printer 51. With the bag 63 on the frame 67, the frame is pivoted to its inclined position shown in FIG. 6 to feed the bag onto a first pivotable bed 53.

The bed 53 and a second pivotable bed 55 are pivotable about a shaft 70 (FIG. 6) such that when the first bed 53 is inclined, as shown by phantom line in FIG. 2, the second bed 55 is substantially horizontal, and when the former is substantially horizontal (solid line), the latter is vertical. When the first bed 53 is inclined, a bag 63 is fed onto the bed 53 from the bag feeder 52 as shown in FIG. 6. A sensor detects any bag on the first bed.

Figure 15:
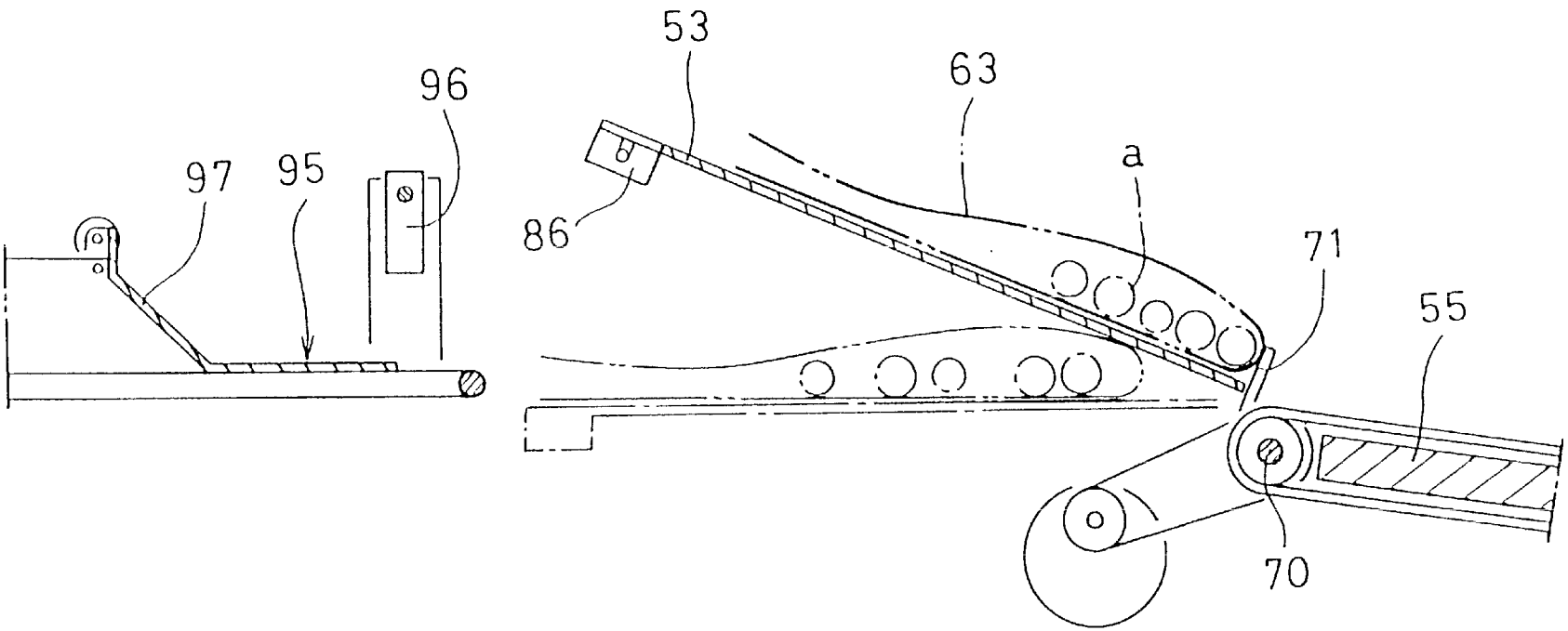
FIG. 15 is a front view showing how bags are dispensed from the bag packaging bed.
Figure 16:
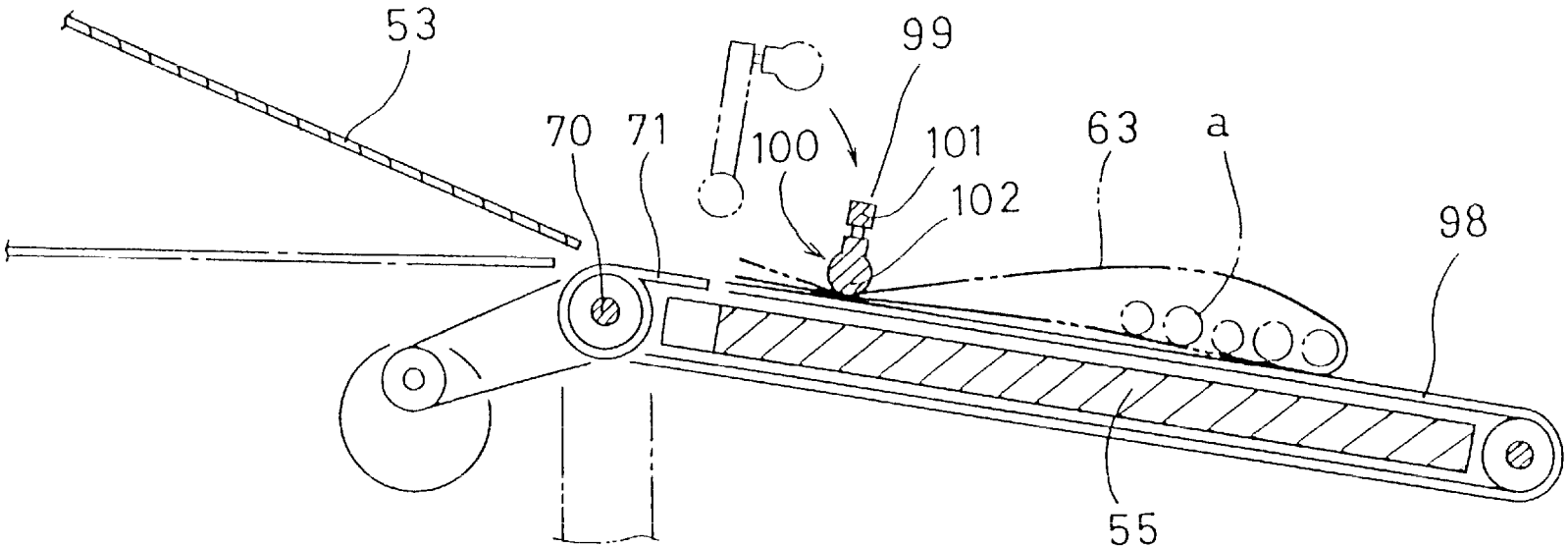
FIG. 16 is a front view showing how a discharge bed receives the bag.

The shaft 70 carries a motor-driven stopper 71 adapted to protrude into the feed path of bags as shown in FIGS. 6 and 15 to prevent a bag on the bed 53 from sliding down onto the second bed 55, and to lie flat as shown in FIG. 16 to allow a bag to slide down onto the second bed.

Figure 7:
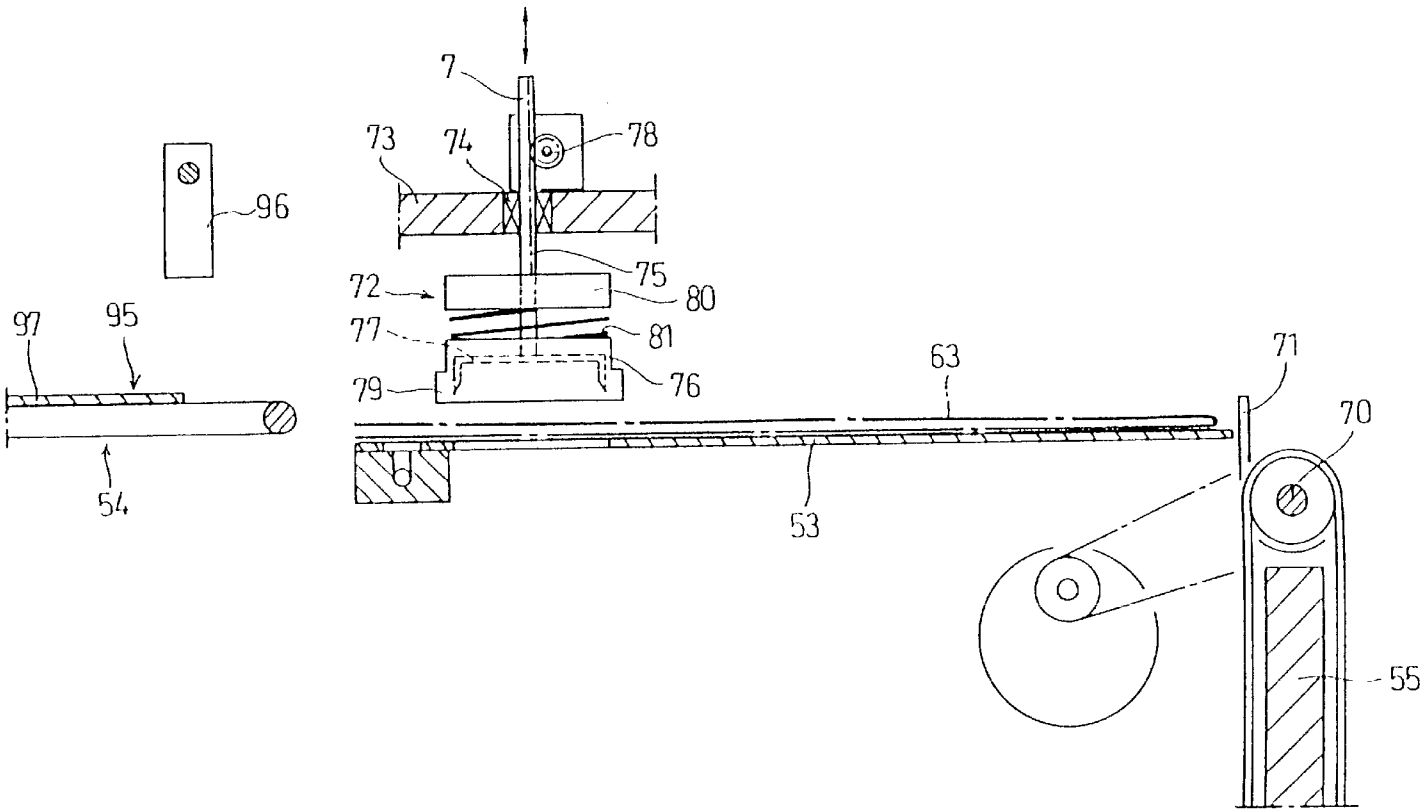
FIG. 7 is a front view of a cutter unit.
Figure 8:
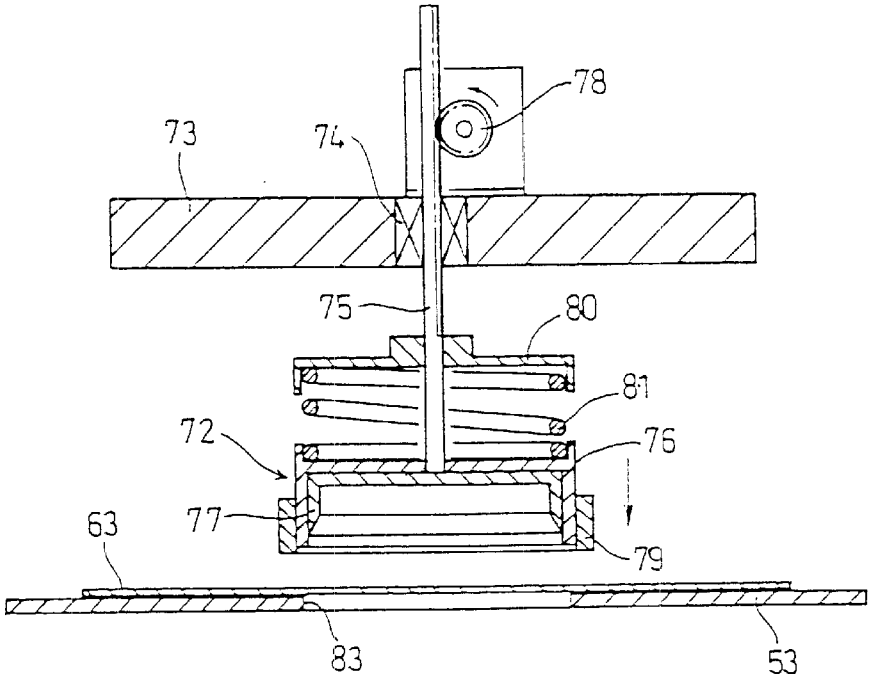
FIGS. 8 and 9 are enlarged front views of the cutter unit.
Figure 9:
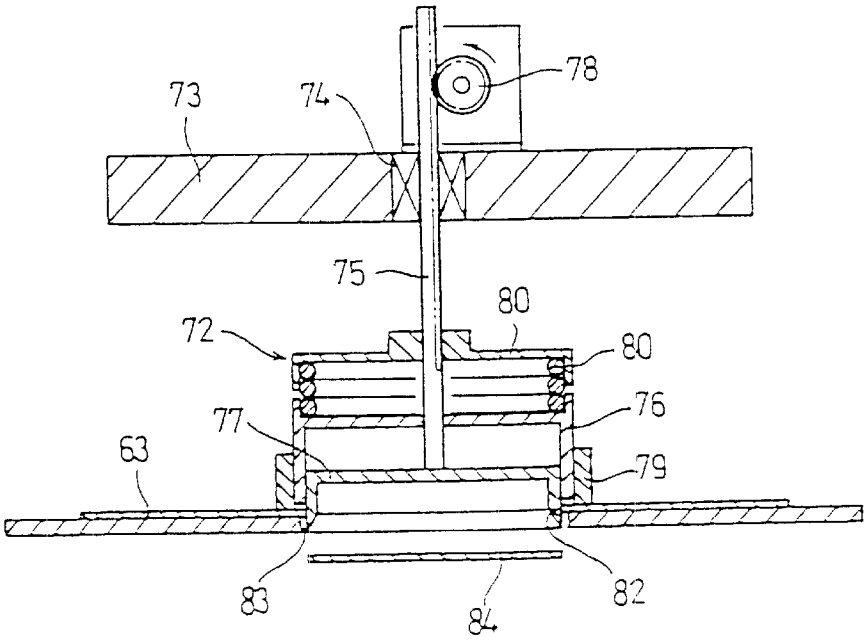

Referring now to FIGS. 7–9, a hole forming unit 72 is provided over the first bed 53. It includes a rod 75 formed with a rack and axially slidably supported by a fixed frame 73 through a slide bearing 74. A round cutter blade 77 is secured to the bottom end of the rod 75. A cylindrical cover 76 is axially slidably mounted on the rod 75. With this slide, the round blade 77 protrudes and retracts from the cover 76.

When the rod 75 is lowered by rotating a pinion 78 in mesh with the rod 75, a packing 79 mounted around the cover 76 grips it. When the rod is further lowered, the blade 77 pierces through the bag, forming a hole 82 in the bag, with the cover 76 remaining stationary while a spring presser 80 fixed to the rod 75 compresses the spring 81. The cut portion 84 is dropped through a hole 83 in the bed 53. The cutter unit has a position sensor unit for detecting the position of the blade 77 comprising a magnet mounted to the rod 75 and upper and lower limit position sensors mounted to the frame 73. A bag 63 formed with a hole 82 can be hung on the neck of a vial by using the through hole 82.

Figure 10:
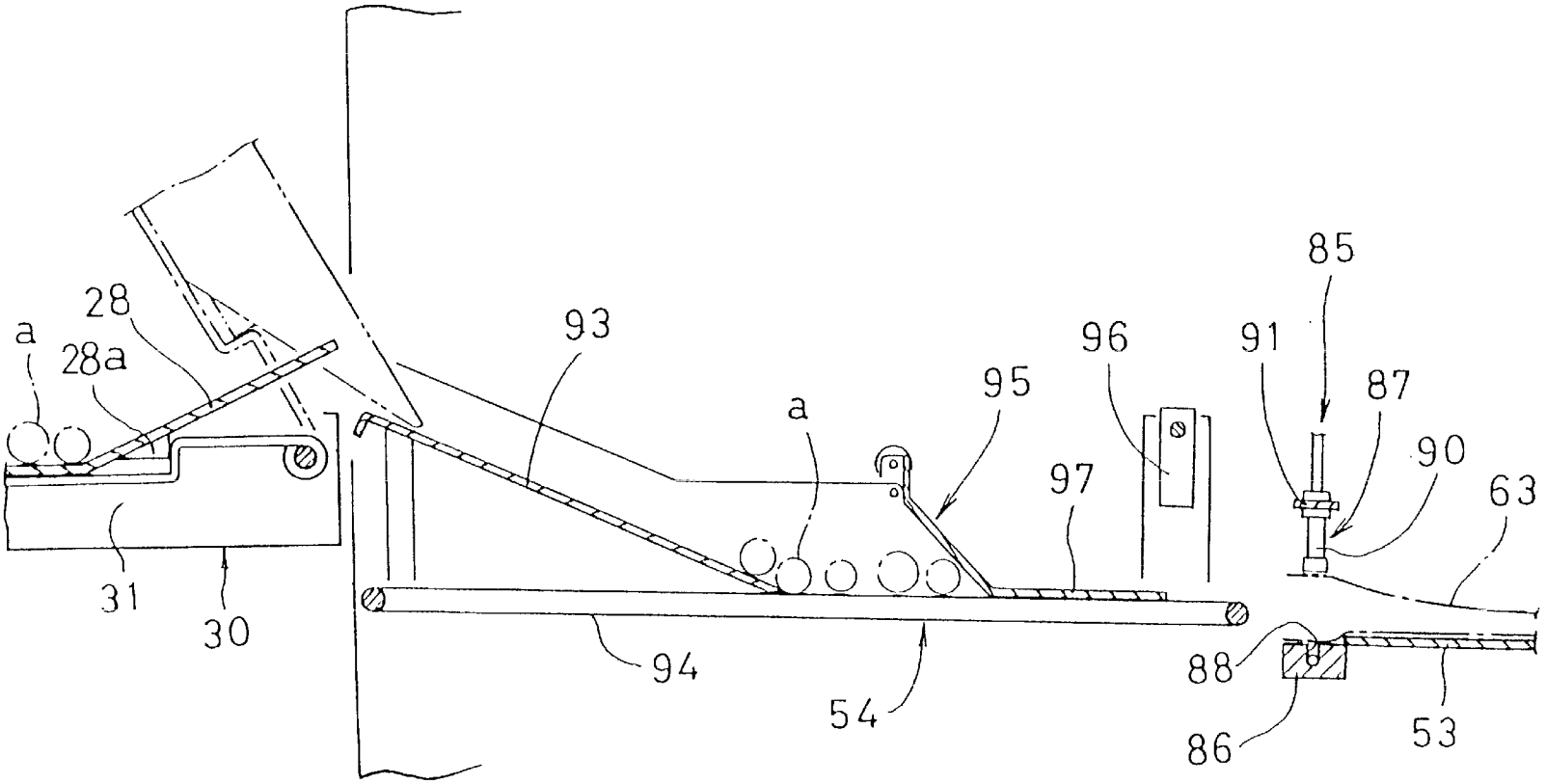
FIGS. 10 and 11 are front and plan views of the drug feed unit respectively.
Figure 12A:
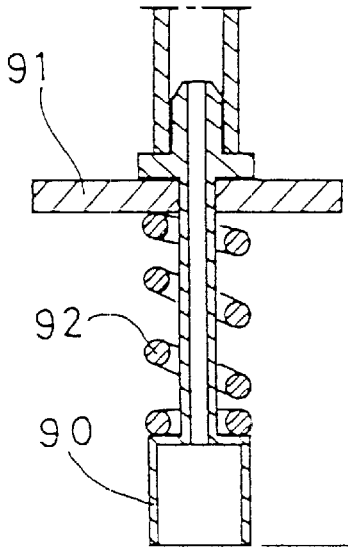
FIG. 12 is a front view of an upper sucker.
Figure 12B:
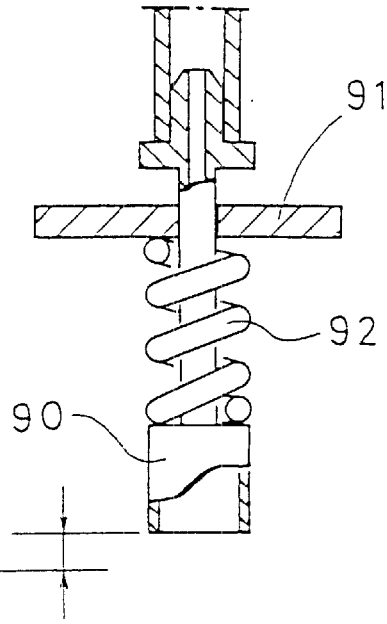
Figure 13:
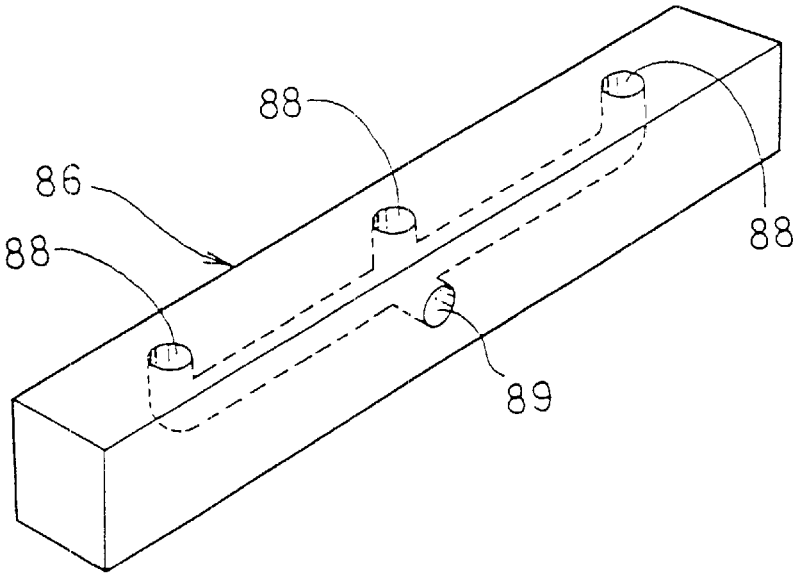
FIG. 13 is a perspective enlarged view of a lower sucker.

As shown in FIG. 10, the first bed 53 has a first mouth-opening unit 85 comprising an upper sucker 87 and a lower sucker 86. The lower sucker 86 (FIG. 13) has three ports 88 arranged transversely of the first bed 53 and connected through a common port 89 to a compressor. The upper sucker 87 (FIG. 12) includes a pair of sucker tubes 90 having suction ports at the bottom ends and having their top ends connected to a compressor. As shown in FIG. 12, the tubes 90 are vertically slidable relative to a mounting plate 91 movably mounted to the first bed 53 and biased downwardly by springs 92.

When a bag is fed onto the first bed 53, the bed is pivoted to the horizontal state, and the compressor of the first mouth-opening unit 85 is activated to suck the top and bottom sides of the bag to the upper and lower suckers 87, 86. The upper sucker 87 is raised to open the bag 63 by about 20 to 30 mm. The bag is placed on the first bed with the thin transparent sheet facing downward. Thus, in order to prevent the thin sheet from being wrinkled or torn apart, suction force is dispersed to the three ports 88, and each port has a reduced diameter (5 mm).

Figure 11:
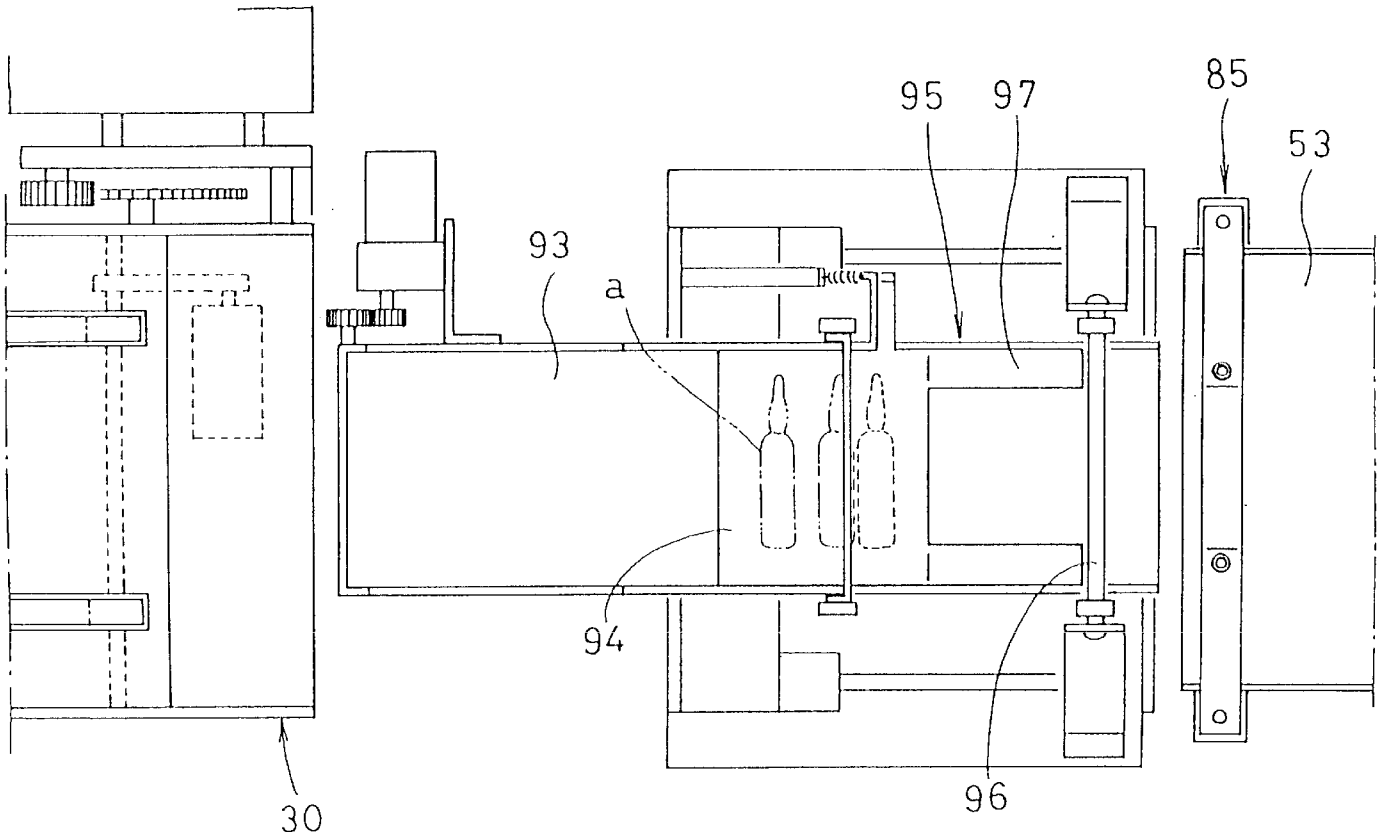
Figure 14:
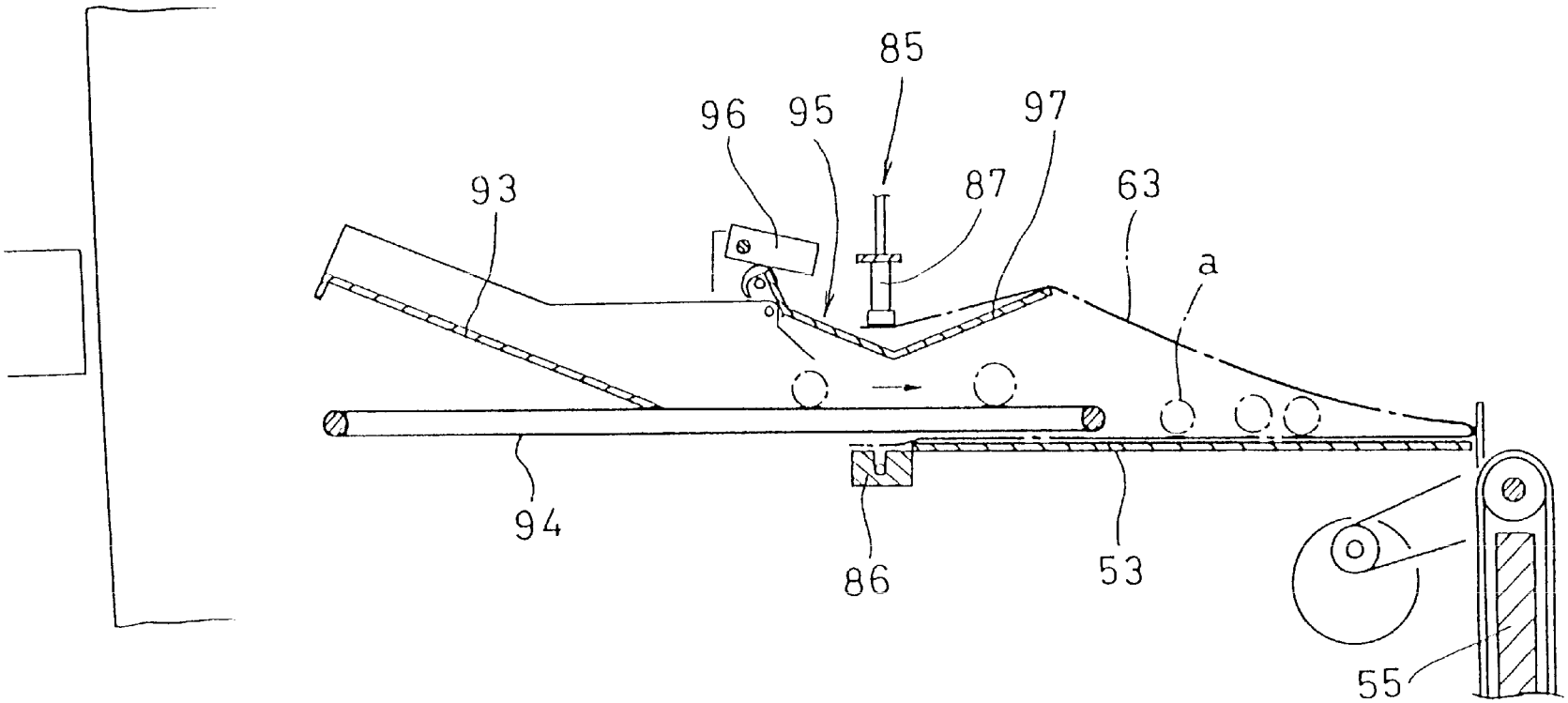
FIG. 14 is a front view showing how drugs are packaged.

FIGS. 10 and 11 show an injection drug (ampules) feed unit 54. It comprises a conveyor 94 for feeding ampules (a) from a chute 93 onto the first bed 53, and a second mouth-opening unit 95. The conveyor 94 is horizontally reciprocated by a motor between a position in which its front end is located right over the free end of the first bed 53, and a position spaced from the bed 53. A cover is provided on the back side of the conveyor 94 to prevent the ampules from getting caught while being discharged. Referring now to FIG. 14, the second mouth-opening unit 95 comprises an arm 97 that reciprocates together with the conveyor 94 between the advanced and retracted positions. When the arm 97 is moved from the retracted position (FIG. 10) toward the advanced position (FIG. 14), it abuts an abutment piece 96 and is pivoted counterclockwise to further widen the mouth of the bag, which has been opened by the first mouth-opening unit 85. With the mouth of the bag opened widely by the arm 97, the conveyor 94, carrying ampules (a) thereon, enters the bag to feed the ampules into the bag. The arm 97 is made of a flexible material so as not to break the bag.

Now referring to FIG. 16, conveyor belts 98 surround the second bed 55, and a presser unit 99 is provided. The moving distance of the belts 98 is adjustable freely and calculated from the rotation angle of the belt-driving motor. As shown in FIG. 15, when the bag on the first bed 53 has been filled with ampules, the bed 53 is pivoted from the horizontal position to the inclined position and the stopper 71 is retracted as shown in FIG. 16. Then, the belts 98 are driven to let the bag move onto the second bed 55, which is now kept in a substantially horizontal position. The belts 98 stop when a sensor detects that the bag has moved to a predetermined position.

Figure 17:
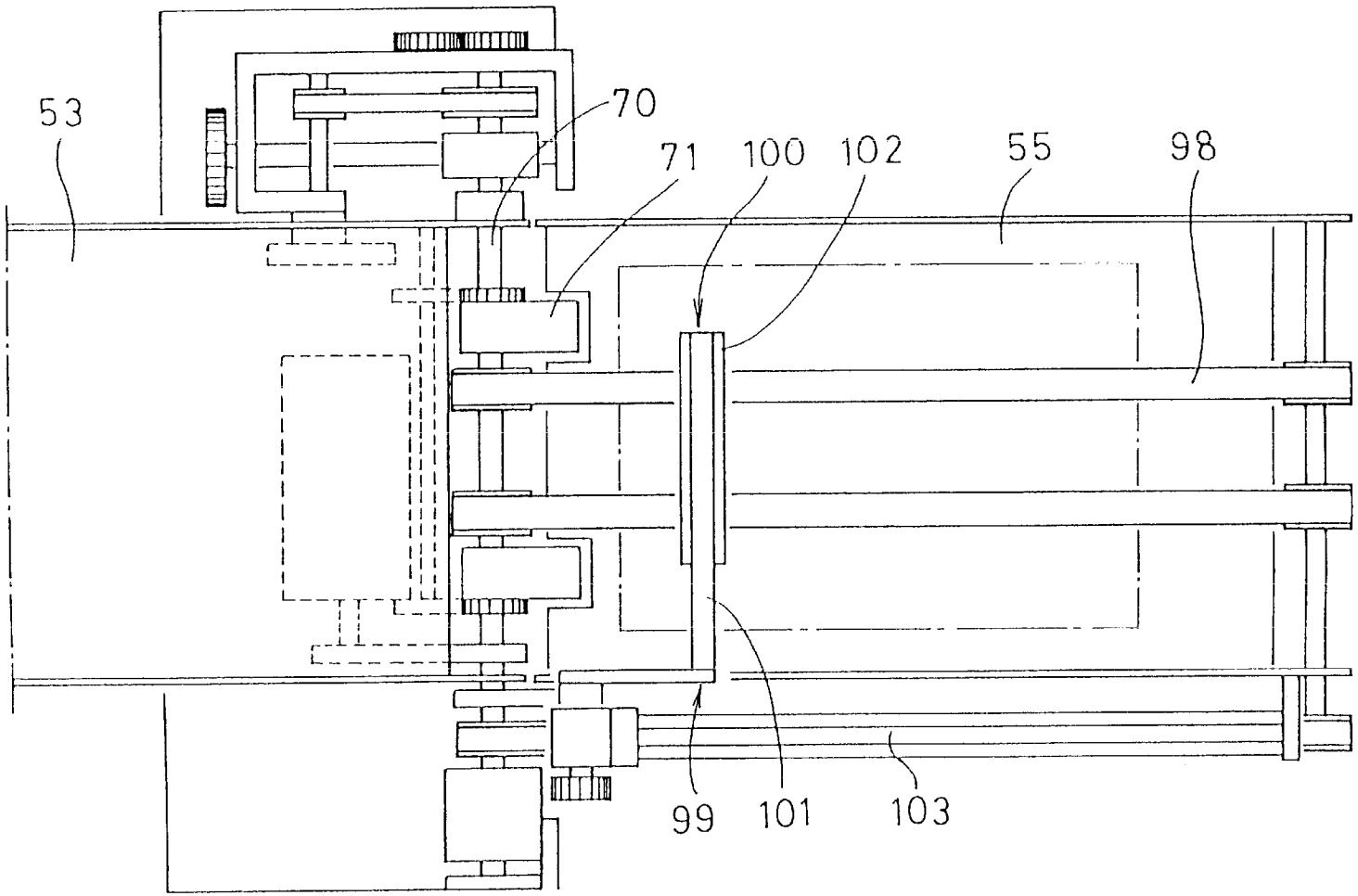
FIG. 17 is a plan view of the discharge bed.
Figure 18:
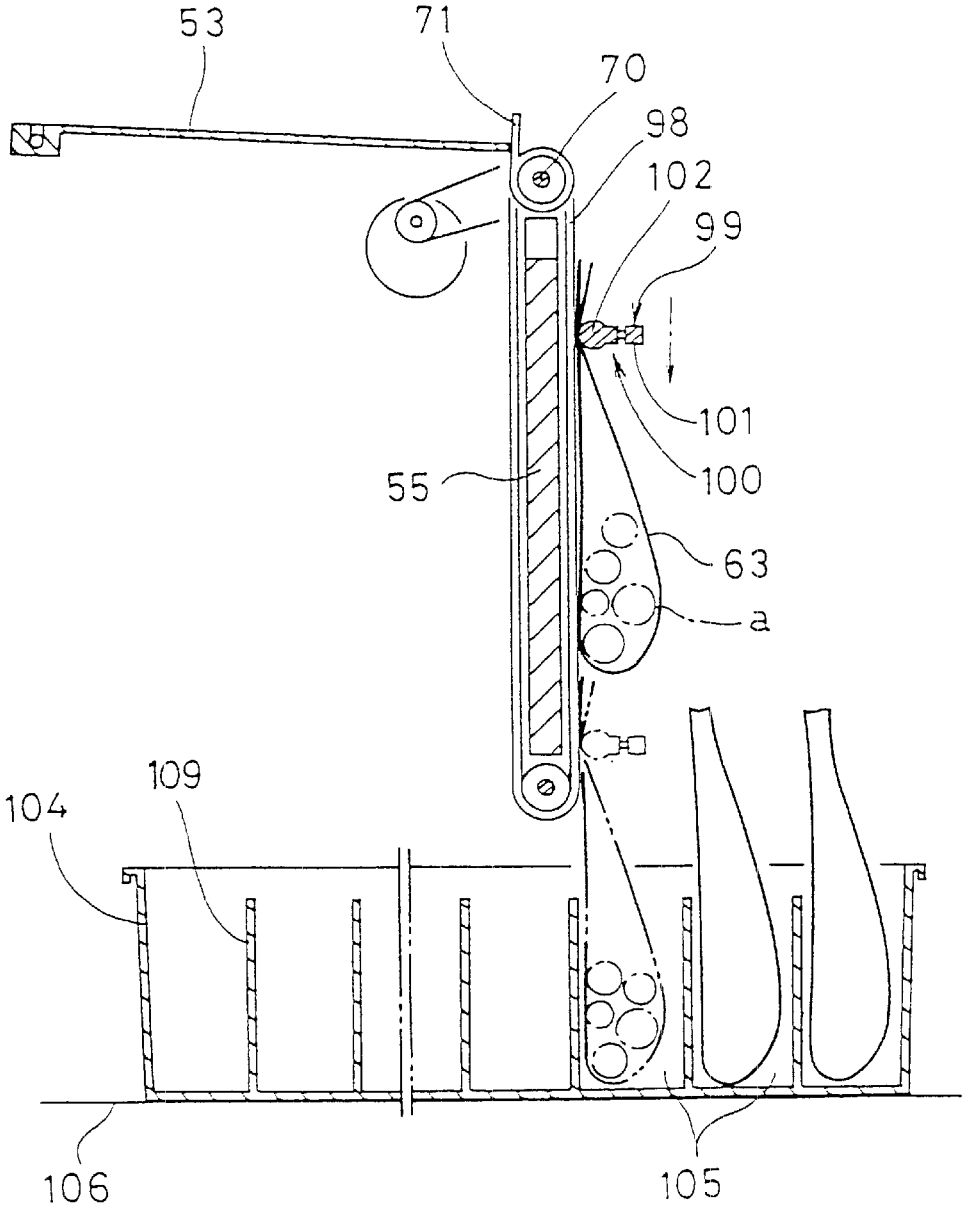
FIG. 18 is a front view showing how the discharge bed dumps the bag into a bucket.

As shown in FIGS. 16–18, the presser unit 99 has a clamp unit 100 that is movable along the second bed 55. The clamp unit 100 comprises a motor-driven arm 101 having one end thereof pivotably coupled to an endless belt 103 trained around the shaft 70 and a pulley at the forward end of the second bed 55, and a presser 102 mounted to the other end of the arm 101. The pulley has a built-in electromagnetic clutch. When the clutch is engaged, the pulley and thus the endless belt 103 are driven together with the conveyor belts 98.

When a bag 63 has been placed on the bed. 55, the arm 101 is pivoted from the position shown by phantom line in FIG. 16 to the position shown by solid line to close the mouth of the bag by sandwiching the bag end between the presser 102 and the belts 98. Then, the second bed 55 is pivoted to the vertical position, and the belts 98 and the endless belts are driven to feed the bag downward and put it into a compartment 105 of a bucket 104 located right under the bed 55 as shown in FIG. 18. In this state, the arm 101 is pivoted counterclockwise to release the bag and the clamp unit 100 is returned to its original position.

As soon as a bag has been moved from the bed 53 onto the second bed 55, the stopper 71 protrudes. If there is another bag 63 in the bag feeder 52, the bag 63 is fed to the first bed 53 and ampules are put into this bag, while the bag on the second bed 55 is being discharged into the bucket 104.

Under the second bed 55, a bucket-feed belt conveyor 106 is provided as shown in FIG. 2. An empty bucket 104 is put on the conveyor 106 from a bucket stocker 107 (FIG. 1), and is moved intermittently so that each compartment 105 will be positioned one after another to the position right under the second bed 55 to receive the bags 63 in the respective compartments 105 from the bed 55. When bags are put in all the compartments 105, the bucket 104 is returned to the bucket stocker 107.

Since bags are made of a flimsy material, when a bag is put in one compartment of the bucket, its top portion may bend and close the opening of an adjacent compartment, making it impossible to put another bag in this compartment. A stick 108 shown in FIG. 2 is provided to prevent this problem. It is adapted to move in the opposite direction to bend the bag, and then it is returned to its original position. The stick 108 may be mounted to a motor-driven link mechanism as shown, or may be mounted to an endless belt driven in either direction. Alternatively, wind may be used for this purpose. Also for this purpose, the partitioning walls 109 defining the compartments 105 may be inclined in the feed direction of the conveyor 106.

As shown in FIG. 1, empty buckets 104 are stacked one above another in the bucket stocker 107 and are fed to the packaging unit 50 as required, and after being filled with bags 63, the buckets 104 are returned into the stocker 107 and stacked.

Each bag 63 contains ampules designated in one doctor's order only (for one-time use only). Thus no human error can happen.

Since such bags 63 for two or more patients can be put in one bucket 104, it is possible to reduce the number of buckets needed. This eliminates the need for racks 16 (FIG. 36) for storing many buckets. The rack collecting work and the space for racks can be saved.

Figure 23:
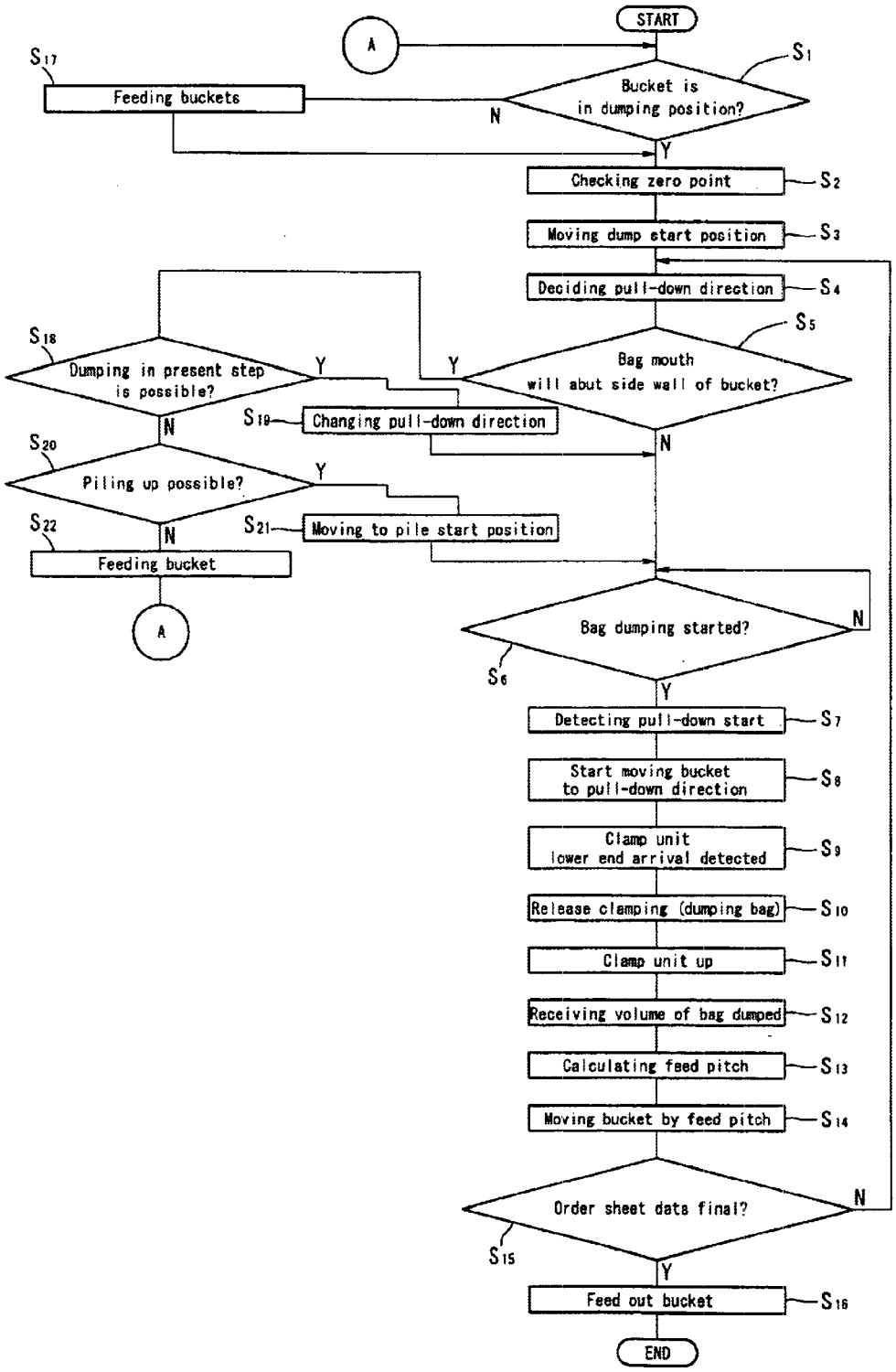
FIG. 23 is a flowchart illustrating the steps of putting bags in a bucket.

Instead of the buckets 104 shown, those having no partitions 109 may be used. In this case, bags 63 are laid flat in the bucket. With this arrangement, a greater number of bags can be put in each bucket 104, so that it is possible to further reduce the number of buckets needed. How bags are put in partition-less buckets is described with reference to FIG. 23.

The computer checks if a bucket 104 is located right under the bed 55 (S1). If not, the bucket 104 is delivered to this position from the stocker 107 (S17). The zero point of the bucket 104 is checked (S2). The computer then moves the bucket to a dump starting point (S3).

Figure 19:
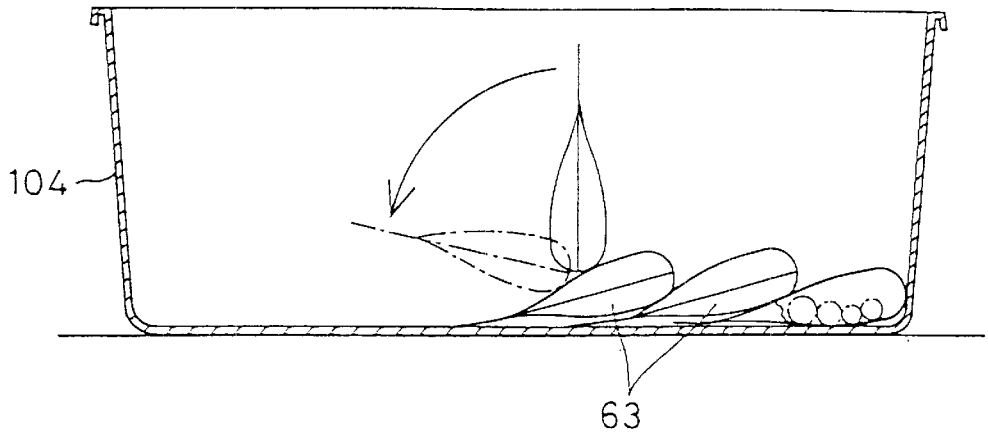
FIG. 19 is a view showing how bags are put in a bucket.

The computer then determines the direction in which bags 63 are to be pulled down (S4), and judges from the data the size of bag and bucket if the mouth of a bag abuts an end wall of the bucket 104 if pulled down in this direction (S5). If not, a bag 63 is lowered into the bucket (S6). When the pulling down of the bag is detected to start (S7), the conveyor 106 is driven to move the bucket 104 to pull down the bag in the direction determined by the computer (S8). For example, the bags in FIG. 19 are pulled down counterclockwise by moving the conveyor 106 rightwardly while lowering the bag. When it is detected that the presser unit 99 has been lowered to the lowermost position (S9), the presser unit 99 is released to put the bag into the bucket 104 (S10).

The presser unit 99 is then raised (S11), and the data about the volume of the bag 63 is inputted (S12). The amount of overlap is determined based on the volume of the first bag (S13). That is, if the first bag is a fat one, the amount of overlap has to be small. Then, the computer moves the bucket 104 by a pitch required to achieve the predetermined overlap (S14). The next bag is then lowered and pulled down in the same manner as the first bag. Every time a bag is put in the bucket, the computer asks if there is another bag to be put in the bucket (S15). If yes, the bag dumping motion is repeated as in FIG. 19. If there is not, the bucket 104 is returned to the stocker 107 (S16).

Figure 20:
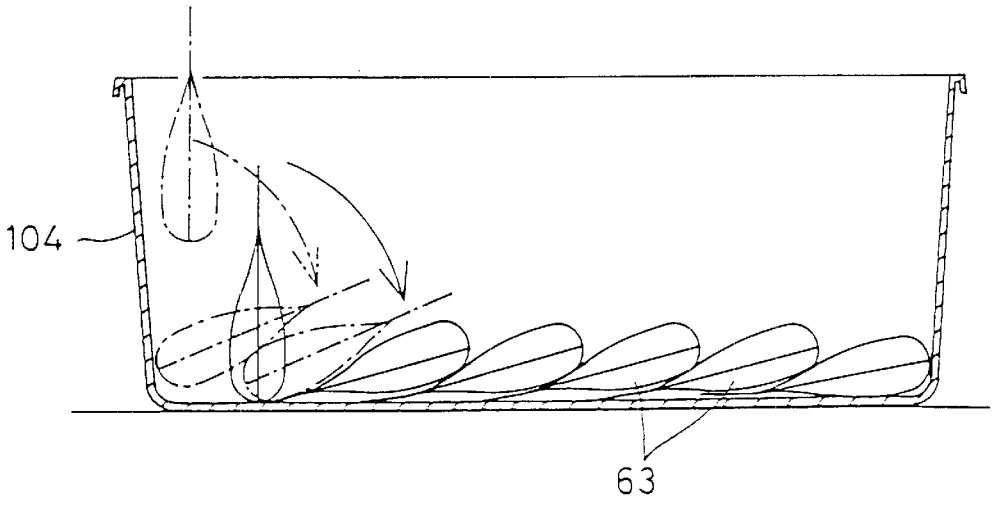
FIG. 20 is a view showing how the direction of pulling down the bags is changed.
Figure 21:
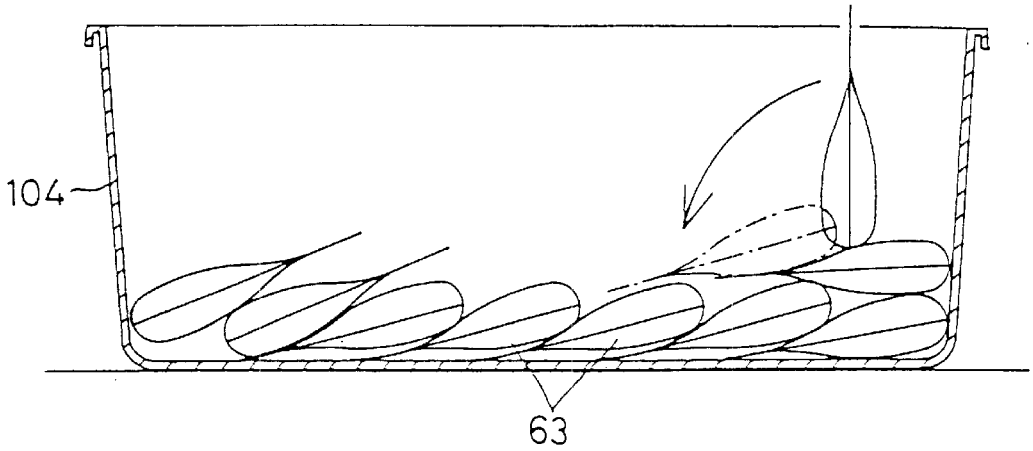
FIGS. 21 and 22 are views showing how the bags are accumulated.
Figure 22:
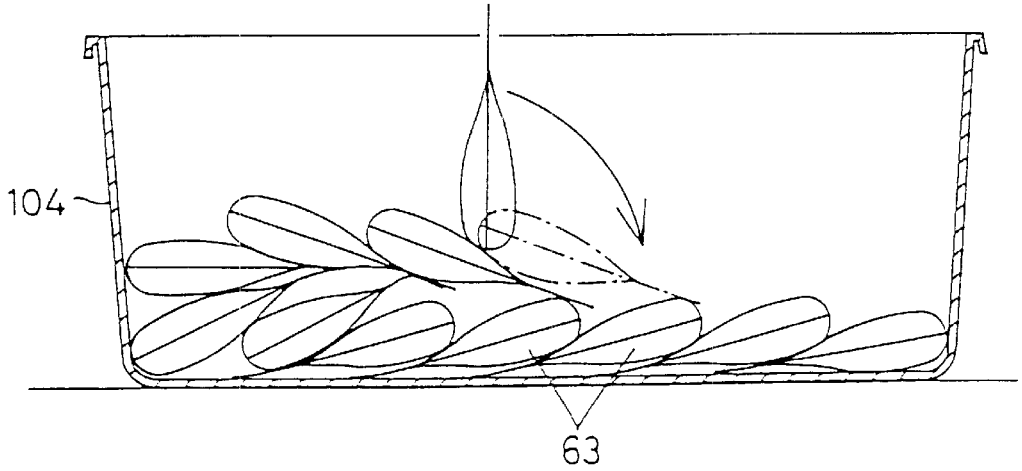

If the computer judges that the mouth of the bag will abut an end wall of the bucket (S5), the computer then judges whether or not it is necessary to change the moving direction of the conveyor (S8). If yes, it now moves the conveyor in the opposite direction to pull down the bag in the opposite direction (S19). For example, if the bag shown by chain line in FIG. 20 is pulled down counterclockwise by moving the bucket rightwardly, the mouth will abut the left side wall of the bucket. Thus, the computer moves the bucket leftwardly to pull down the bag clockwise as shown by arrows in FIG. 20 (S21). When it is judged impossible to lay a bag on the first level (S20), bags are laid on the second level from the righthand end as shown in FIG. 21 or from the lefthand end as shown in FIG. 22. When the bucket becomes full, it is returned to the stocker and the step back to S1.

Figure 24:
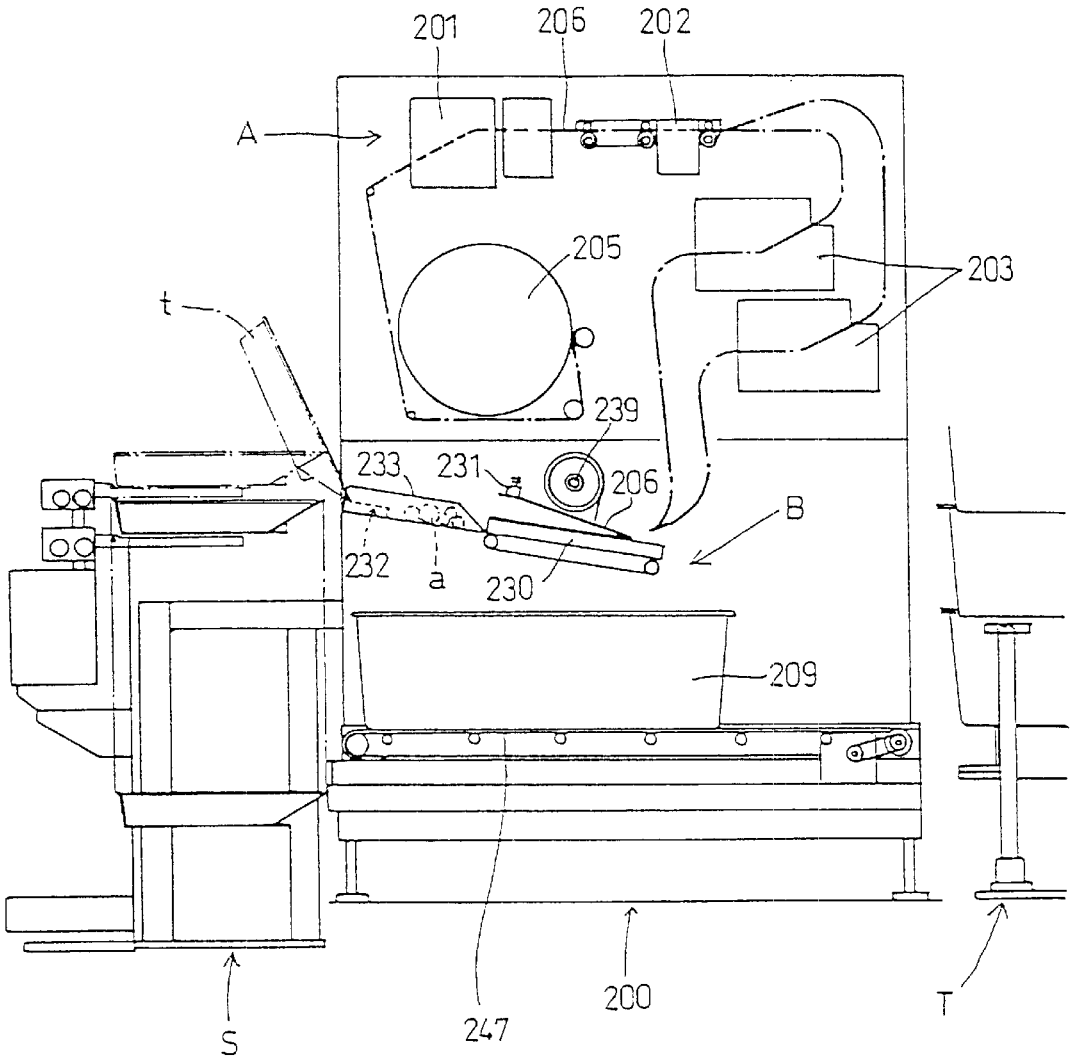
FIG. 24 is a schematic view of another embodiment of the injection drug packaging/dispensing system embodying the present invention.

FIG. 24 shows a modified packaging device 200 embodying the invention, which comprises a bag supply unit A and a packaging unit B. A lifter S is provided on one side of the device 200 and a stocker T is provided on the other side.

The bag supply unit A comprises a bag making unit 201, a cutter unit 202, and printers 203. The bag making unit 201 makes bag by unrolling a roll 205 of double-layer, heat-fusible sheet material comprising a substrate and a transparent laminate layer having both longitudinal side edges fused to the substrate and heat-sealing and cutting the sheet transversely at predetermined intervals to make bags 206. The cutter 202 forms a hole in each bag 206 into which the neck of a transfusion bottle is to be inserted. The printers 203 print necessary information on the bags based on doctors' orders. For higher efficiency, the two printers can print information on two bags simultaneously. The thus printed bags are sent to the packaging unit B, filled with necessary drugs (a) and put into a bucket 209.

Figure 25:
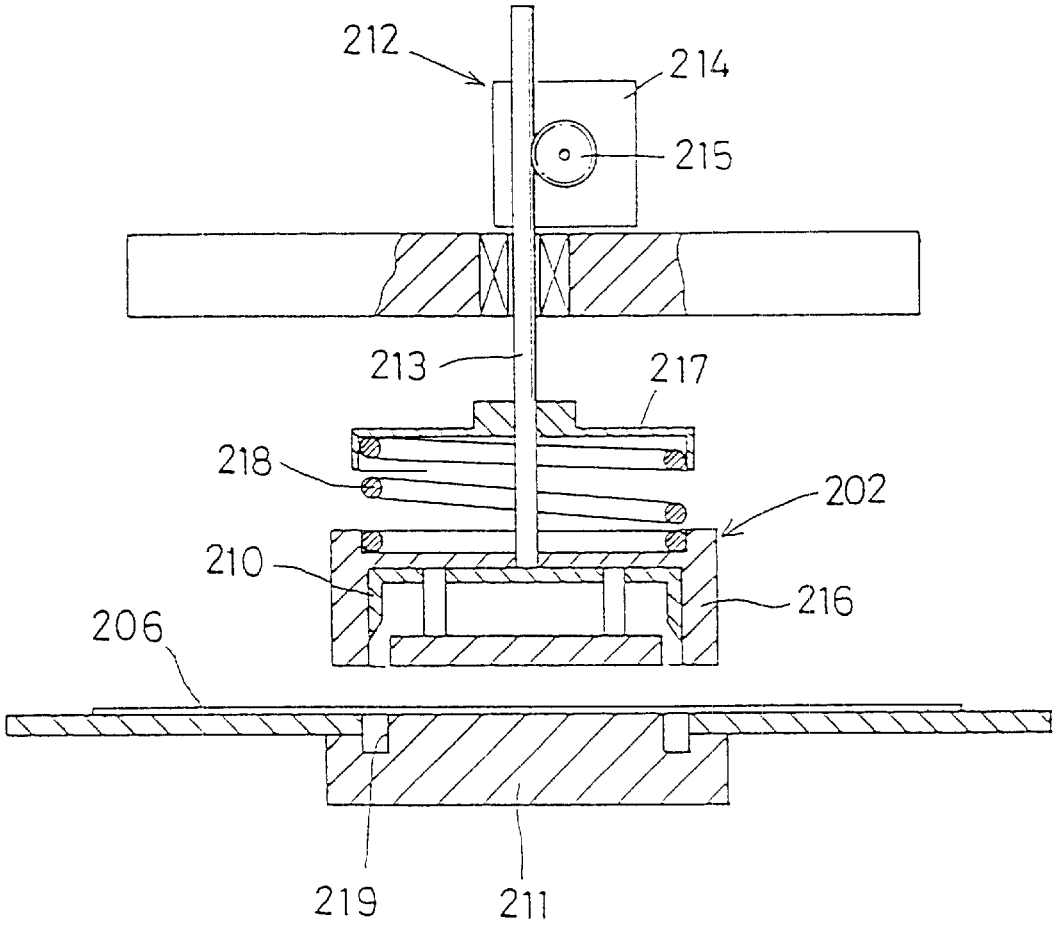
FIGS. 25 and 26 are sectional views of the cutter unit showing the state before and during the process of forming a hole.
Figure 26:
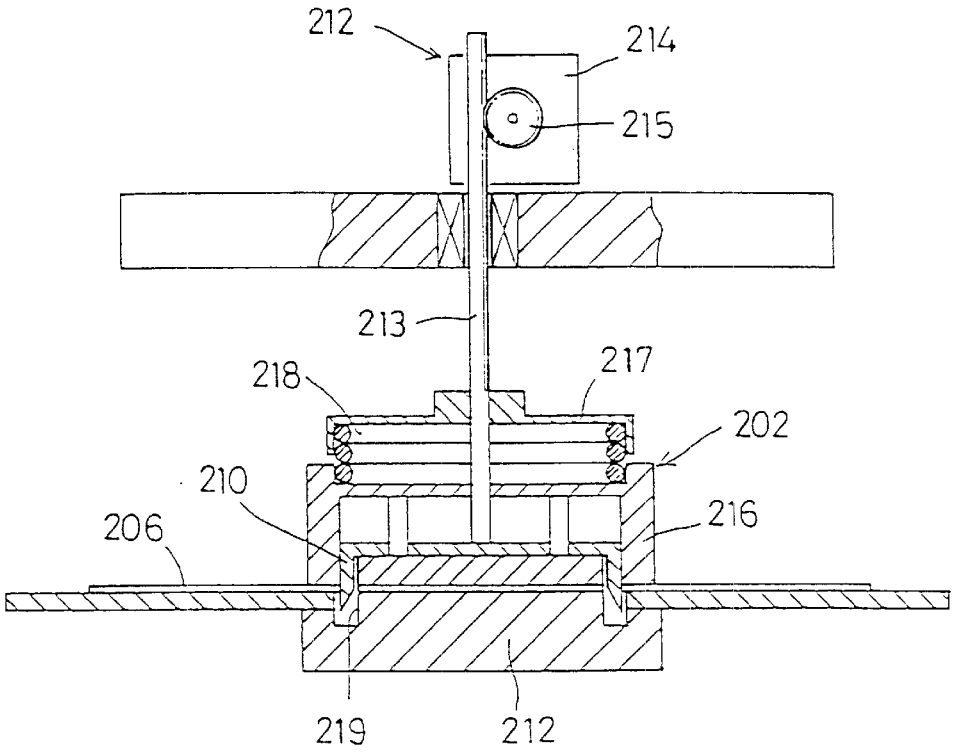

Referring to FIGS. 25 and 26, the cutter unit 202 has a cutter 210 coupled to a bottom end of a rack 213 in mesh with a gear 215 driven by a motor 214. A cover 216 is slidably mounted on the rack 213 to cover the cutter 210. A spring 218 is mounted around the rack between the cover 216 and a spring seat 217 fixed to the rack 213 to bias the cover 216 downwardly. The support 211 has a top groove 219 in which the cutter 210 is received.

Figure 27:
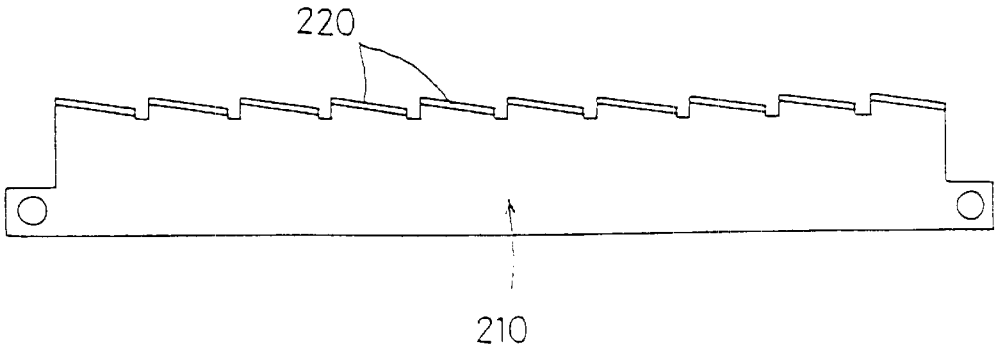
FIG. 27 shows the cutter before being bent.
Figure 28:
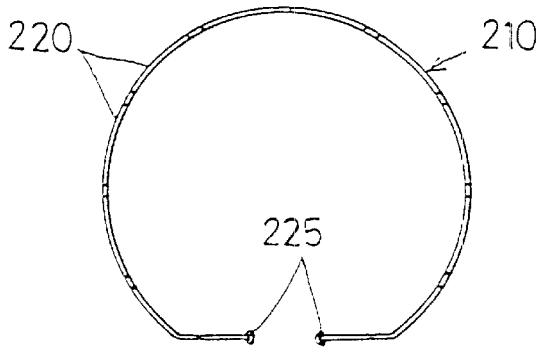
FIG. 28 shows the cutter as mounted on the cutter unit.

As shown in FIG. 27, the cutter 210 is formed by circularly bending a thin plate having plural discontinuous blades 220, and as shown in FIG. 28, the thin plate is bent and mounted on the rack 213. The blades 220 have cutting edges that are inclined in the same direction as shown in FIG. 27.

Figure 29:
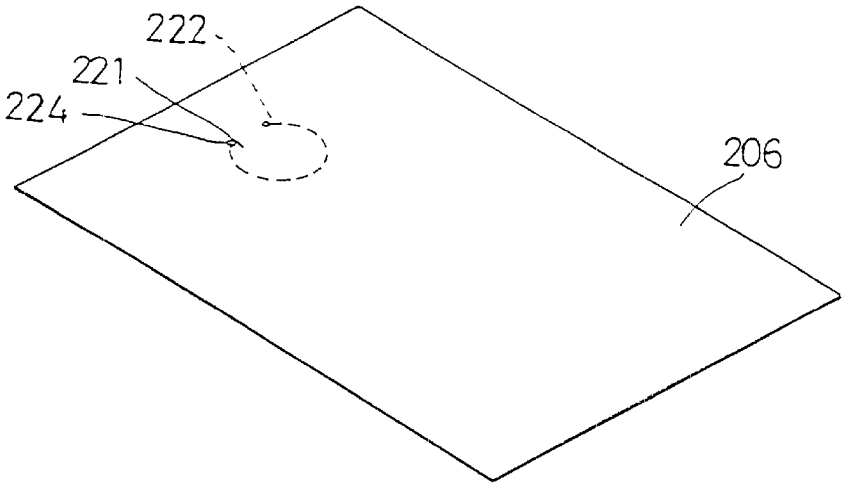
FIG. 29 is a perspective view of a bag formed with a circular hole.

With a bag 206 placed on the support 211 as shown in FIG. 25, the gear 215 is rotated by the motor 214 to lower the rack 213 and the cutter 210. Until the cover 216 touches the bag, it is lowered together with the cutter. Once it engages the bag, only the rack and the cutter are lowered further until the cutter 210 pierces through the bag and is received in the top groove of the support 211 as shown in FIG. 26, while the cover 216 remains stationary, compressing the spring 218. As shown in FIG. 29, perforations 222 arranged along an imaginary circle are thus formed in the bag 206.

Figure 30:
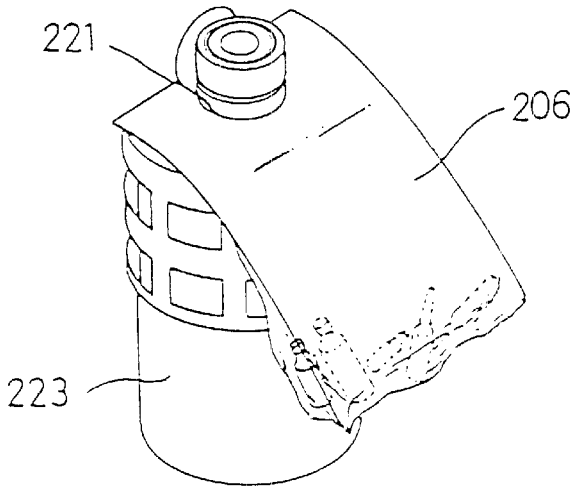
FIG. 30 is a perspective view of a transfusion bottle having its neck inserted in the hole of the bag.

As shown in FIG. 30, the portion inside the imaginary circle is removed along the perforations 222 to form a circular hole 221 into which the neck of a transfusion bottle is to be inserted. Preferably, the perforations are not formed over the entire circumference of the imaginary circle. Instead, a portion having no perforations is provided along the imaginary circle as shown in FIG. 29 so that the portion of the bag inside the imaginary circle will not be completely separated from the bag.

In this arrangement, in which the cutter unit 202 is provided upstream of the packaging unit B, the perforations 222 are formed while the bag is empty and thus flat. Thus, it is possible to form perforations 222 reliably. Also, the hole 221 is formed by removing the portion surrounded by the perforations only after ampules have been put in the bag. This prevents ampules from getting out of the bag through the hole 221.

Since the blades 220 are inclined in one direction, they come into point contact with the bag, and thus perforations 222 can be formed easily in comparison with the case in which blades that are not inclined are used.

Since the cutter 210 is a thin plate, it is inexpensive and is easily exchangeable.

Figure 31:
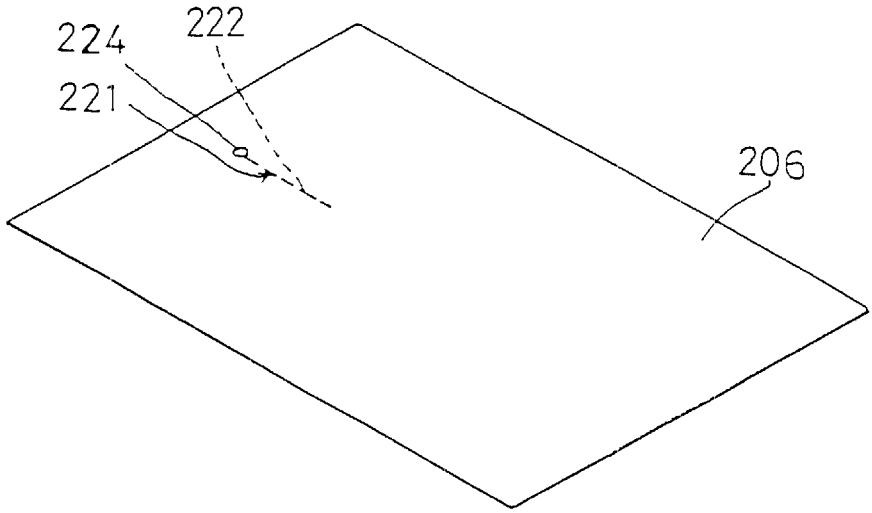
FIG. 31 is a perspective view of a bag formed with a straight slit.

Instead of the circular cutter, a straight cutter may be used to form perforations arranged parallel to the side edges of the bag as shown in FIG. 31 to more positively prevent spilling of ampules.

Figure 32:
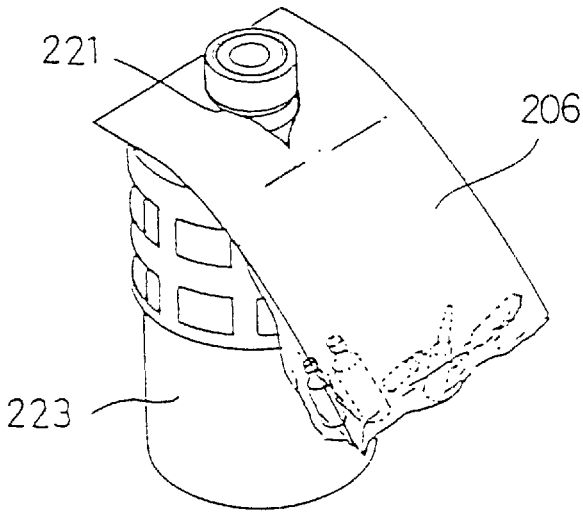
FIG. 32 is a perspective view of a transfusion bottle having its neck inserted in the slit of the bag of FIG. 31.

A slit is formed by tearing the portions between the perforations, and the neck of a transfusion bottle 223 is pushed into the slit as shown in FIG. 32. The perforations should be formed such that the slit is only slightly longer than the diameter of the bottleneck so that the bottleneck will not easily come out of the slit.

As shown in FIGS. 29 and 31, a small round hole 224 is formed at least at the end of the perforated line near the mouth of the bag so that the slit formed by tearing the portions between the perforations will not extend to the mouth, thereby making it impossible to hang the bag on a bottle. Such a small hole 224 is formed by an integral or separate punch 225 provided at the end of the cutter 210 (FIG. 28).

Referring now to FIGS. 24 and 33–35, the packaging unit B comprises a bed 230 on which is placed a bag 206, a first and a second mouth-opening unit 231, 232 for opening the mouth of a bag 206 on the bed 230, and a chute 233 for putting the ampules into the bag through the mouth.

Figure 34:
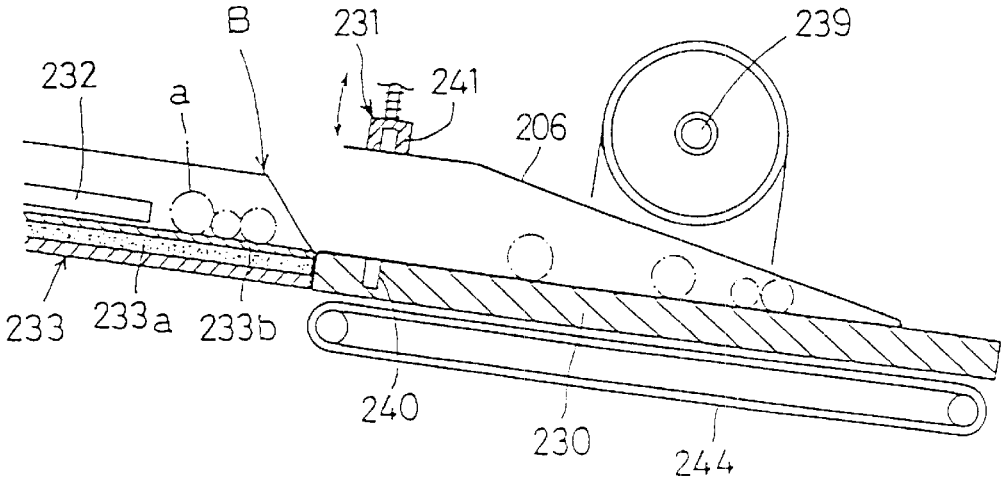
FIG. 34 is a schematic view showing how the packaging unit feeds the drugs into a bag.

As shown in FIG. 24, a plurality of trays (t) in which are stored ampules are stacked in the lifter S. The uppermost tray is inclined as shown to dump the ampules therein onto the chute 233. The ampules dumped onto the chute slide down the chute and drop off at its discharge end. As shown in FIG. 34, the bottom of the chute has a double-layer structure comprising a shock-absorbing sponge layer 233*a*, and a surface layer 233*b* of Teflon (trademark of Du Pont for tetrafluoroethylene resin). The sponge layer allows soft landing of ampules, and the Teflon layer allows smooth sliding.

Figure 33:
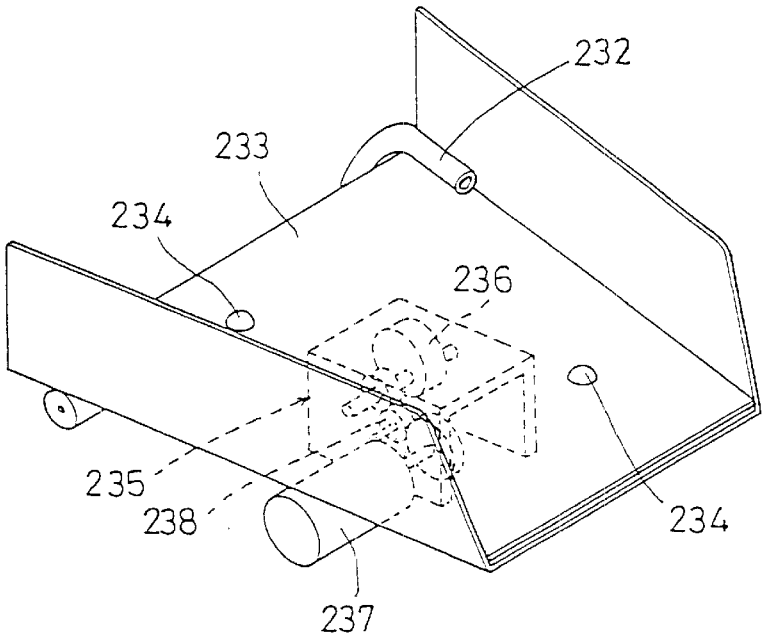
FIG. 33 is a perspective view of a chute.

As shown in FIG. 33, two protrusions 234 are provided on the bottom of the chute 233 to change the attitude of any ampule lying transversely on the chute and thus to prevent the discharge end of the chute from getting clogged by such an ampule.

If the chute 233 is moderately sloped to prevent ampules from getting broken by colliding against each other, a vibrator 235 is preferably mounted to the bottom of the chute 233 as shown in FIG. 33 so that ampules can smoothly slide down the chute into the bag 206. The vibrator of the embodiment comprises a weight wheel 236, and a motor 237 for rotating the weight wheel 236 about an axis offset from the central axis of the weight wheel 236 to produce vibration of the chute. A few gears are preferably provided between the weight wheel 236 and the motor 237 to prevent vibration of the wheel 236 from being directly transmitted to the motor. The weight wheel 236 is rotated at a low speed so that the vibration produced by the wheel 236 would not be absorbed by the sponge layer 233*a*.

Figure 35:
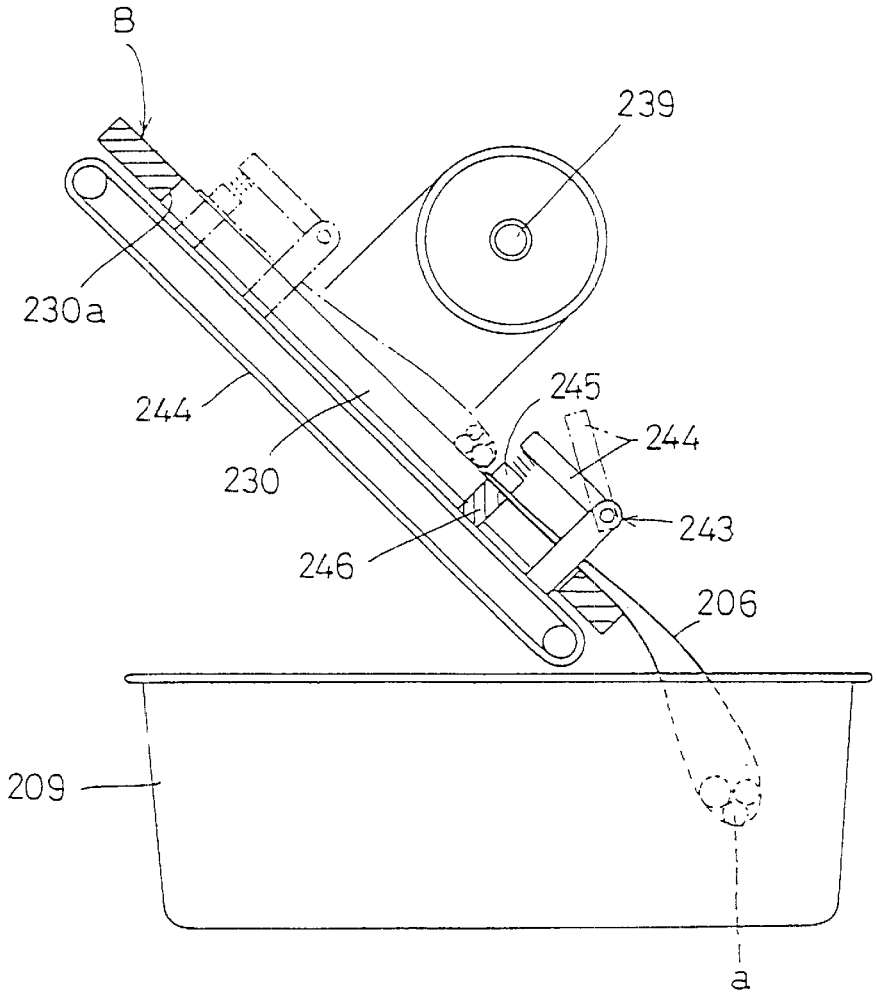
FIG. 35 is a schematic view showing how the bags are dispensed.

FIGS. 24, 34 and 35 show that the bed 230 is pivotable about a shaft 239. At one extreme end of the pivoting motion, a bag is fed onto the bed, at an intermediate position of the pivoting motion, ampules are put into the bag, and at the other extreme end of the pivoting motion, the bags are discharged. At the end of the bed 230 near the chute 233, a lower sucker 240 is provided (FIG. 34). Opposite the lower sucker 240, an upper sucker 241 is vertically movably provided. The upper and lower suckers each have two transversely arranged suction ports connected to an air compressor through air tubes, and form the first mouth-opening unit 231. At the intermediate position of the pivoting motion (FIG. 34), the mouth of the bag 206 on the bed 230 is opened by the mouth-opening unit 231. A pressure sensor is provided in one of the air tubes to measure the suction pressure applied. If the pressure measured is below a predetermined value, the computer judges that the bag 206 is not sucked to the suckers 240 and 241, and thus reciprocates the upper sucker repeatedly until a predetermined negative pressure is reached. If the predetermined negative pressure is not measured after lowering and raising the upper sucker a predetermined number of times, the computer judges that something is wrong with the system and deactivates the compressor.

As shown in FIG. 34, the chute 233 has an air blowing tube 232 as a second mouth opener 232. By blowing air from the tube 232 into the bag 206, the mouth is opened widely, so that ampules can be smoothly fed into the bag.

As shown in FIG. 35, the bed 230 carries a bag presser unit 243 fixed to and moved by an endless belt 244 trained around rotary shafts at both ends of the bed 230. It includes an arm 244 pivoted by a motor and carrying at the free end a presser 245 through a spring, and a presser support 246 received in a longitudinal elongate hole 230*a* formed in the bed 230. To protect bags, the presser 245 and the presser support 246 are covered by a rubber or other resilient sheet. The presser 245 is urged by a spring toward the presser support 246.

With the mouth of a bag 206 containing ampules sandwiched between the presser 245 and the presser support 246, the bed 230 is pivoted to the vertical position, and the bag is put into a bucket 209 by moving the presser unit 243 downwardly and releasing it. When the bag is released, the presser unit 243 returns to the original position, and the bucket is moved a predetermined pitch by a conveyor 247.

When all the necessary bags have been put in the bucket, the bucket is returned to the stocker T by the conveyor 247, and another empty bucket 209 is delivered onto the conveyor 247 from the stocker T.

As described above, according to the packaging unit of this invention, injection drugs are packaged in units for a single use. Thus, mistakes in packaging are avoided.

Also, since one bucket can contain drug bags for a plurality of patients, injection drugs can be distributed in a smaller number of buckets. Thus, it is not necessary to provide bucket stocking racks. Accordingly, rack collecting work and space for the racks are no longer needed.

What is claimed is:

1. An injection drug packaging device comprising a bag supply unit for printing information specified in doctors' orders on bags and feeding the bags, and a packaging unit for putting drugs specified in the doctors' orders into each of said bags received from said bag supply unit and putting the bags into a bucket, said packaging unit comprising a bed for supporting said bags, a mouth-opening means for opening the mouth of the bag on said bed, and a chute through which injection drugs are fed into the bag on the bed through its mouth, said bed being pivotable between a position for putting injection drugs into the bag on the bed and a position for dispensing the bag on the bed.

2. The device of claim 1 wherein said chute has a vibrator.

3. The device of claim 2 wherein said bag supply unit further comprises a cutter unit for forming in each bag a hole in which a transfusion bottle is engageable, said cutter unit comprising a cutter for forming perforations along a line defining said hole, a cutter support provided opposite said cutter, and a presser for urging said cutter into a bag sandwiched between the presser and said cutter support.

4. The device of claim 2 wherein said mouth-opening means comprises a first mouth-opening means for opening the mouth of a bag by sucking the bag from both sides, and a second mouth-opening means for increasing the volume of the bag by blowing air into the bag.

5. The device of claim 1 wherein said mouth-opening means comprises a first mouth-opening means for opening the mouth of the bag by sucking the bag from both sides, and a second mouth-opening means for increasing the volume of the bag by blowing air into the bag.

6. The device of claim 5 wherein said bag supply unit further comprises a cutter unit for forming in each bag a hole in which a transfusion bottle is engageable, said cutter unit comprising a cutter for forming perforations along a line defining said hole, a cutter support provided opposite said cutter, and a presser for urging said cutter into a bag sandwiched between the presser and said cutter support.

7. The device of claim 1 wherein said bag supply unit further comprises a cutter unit for forming in each bag a hole in which a transfusion bottle is engageable, said cutter unit comprising a cutter for forming perforations along a line defining said hole, a cutter support provided opposite said cutter, and a presser for urging said cutter into a bag sandwiched between the presser and said cutter support.

8. The device of claim 7 wherein said cutter comprises a plurality of blades having cutting edges inclined, whereby said cutting edges are brought into point contact with the bag when cutting into the bag.

9. An injection drug packaging device comprising:

a first mouth-opening unit for opening a mouth of each of a plurality of continuously supplied drug bags, said first mouth-opening unit being operable to open the mouth of the drug bag by sucking the bag from opposite sides of the drug bag;

a second mouth-opening unit adapted to be inserted into the mouth of the bag to further widen the mouth of the drug bag opened by said first mouth-opening unit; and a feed unit for feeding injection drugs into each of the drug bags through the bag mouth, said feed unit comprising a belt conveyor having a delivery end and a feeding end, said belt conveyor having a belt trained around rollers provided at the delivery and feeding ends, said belt conveyor being arranged horizontally so as to move injection drugs in a horizontal direction, wherein said entire belt conveyor is movable substantially horizontally along a longitudinal direction thereof, relative to said first mouth opening unit, between a first position at which the delivery end of said belt conveyor can be located in the mouth of an opened bag, and a second position at which the delivery end of said belt conveyor is retracted from the first position, wherein said second mouth-opening unit comprises an arm mounted on said belt conveyor so as to be horizontally movable together with said belt conveyor, wherein said arm has a free end and is pivotal between a first arm position in which the free end is in contact with a top surface of said belt, and a second arm position in which the free end is raised from the top surface of said belt.

10. The injection drug packaging device as claimed in claim 9, further comprising means for putting the bags containing injection drugs into a bucket, and means for moving the bucket in association with the action of putting the bags into the bucket.

11. The injection drug packaging device as claimed in claim 10, further comprising a cutter unit for forming a hole in each of the bags near the mouth of the bag.

12. The injection drug packaging device as claimed in claim 9, further comprising a cutter unit for forming a hole in each of the bags near the mouth of the bag.

13. The injection drug packaging device as claimed in claim 9, wherein said second mouth-opening unit further comprises a mechanism for moving said arm from the first arm position to the second arm position when said belt conveyor has moved to the first position, said arm being kept in the first arm position until said belt conveyor is in the first position.

14. An injection drug packaging device comprising:

a packaging bed for receiving a drug bag;

a first mouth-opening device, positioned adjacent said packaging bed, for opening a mouth of the drug bag that has been received on said packaging bed, said first mouth-opening device being operable to open the mouth of the drug bag by sucking the bag from opposite sides of the drug bag;

a second mouth-opening device adapted to be inserted into the mouth of the bag to further widen the mouth of the drug bag opened by said first mouth-opening means; and a feed unit for feeding drugs into each of the drug bags through an opened mouth of the drug bag, said feed unit comprising an endless conveyor having a delivery end and a feeding end, said endless conveyor being arranged horizontally so as to move the drugs in a horizontal direction, wherein said endless conveyor is movable, substantially horizontally along a longitudinal direction thereof, toward and away from said packaging bed so that the delivery end of said endless conveyor can be positioned in the opened mouth of the drug bag in order to deliver drugs into the drug bag, wherein said second mouth-opening device comprises an arm mounted on said endless conveyor so as to be horizontally movable together with said endless conveyor, wherein said arm has a free end and is pivotal between a first position in which the free end is in contact with a top surface of said endless conveyor, and a second position in which the free end is raised from the top surface of said endless conveyor, wherein said second mouth opening device further includes a mechanism for moving said arm from the first position to the second position when the delivery end of said endless conveyor is positioned in the opened mouth of the drug bag, said arm being maintained in said first position until the delivery end of said endless conveyor is positioned in the opened mouth of the drug bag.

15. The injection drug packaging device as claimed in claim 14, wherein said endless conveyor is movable between a first position and a second position, wherein the delivery end of the endless conveyor is located over said packaging bed in the first position, and the delivery end of the endless conveyor is spaced from said packaging bed in the second position.

* * * * *